US005797599A

United States Patent [19]

Meyer et al.

[11] Patent Number: 5,797,599

[45] Date of Patent: Aug. 25, 1998

[54] PASSBOOK TRANSPORT MECHANISM FOR AUTOMATED TELLER MACHINE

[75] Inventors: Jerry L. Meyer, North Canton; Wayne D. Wellbaum, Massillon; H. Thomas Graef, Bolivar, all of Ohio

[73] Assignee: InterBold, North Canton, Ohio

[21] Appl. No.: 813,134

[22] Filed: Mar. 7, 1997

Related U.S. Application Data

[60] Continuation of Ser. No. 589,094, Jan. 23, 1996, abandoned, which is a division of Ser. No. 258,040, Jun. 10, 1994, Pat. No. 5,507,481.

[51] Int. Cl.[6] ..... B65H 5/00

[52] U.S. Cl. ..... 271/272; 271/275; 271/188; 271/198

[58] Field of Search ..... 271/272, 188, 271/198, 240, 248, 275

[56] References Cited

U.S. PATENT DOCUMENTS

| | | | |
|---|---|---|---|
| 3,999,749 | 12/1976 | Zambolin et al. . | |
| 4,106,767 | 8/1978 | Schirrmeister et al. . | |
| 4,279,413 | 7/1981 | Siwik et al. . | |
| 4,743,129 | 5/1988 | Keryhuel | 271/245 |
| 4,850,583 | 7/1989 | Monday . | |
| 5,035,415 | 7/1991 | Lee et al. . | |
| 5,091,754 | 2/1992 | Abe et al. . | |
| 5,098,081 | 3/1992 | DeFigueiredo . | |
| 5,142,129 | 8/1992 | Nakamura et al. | 271/274 |
| 5,165,679 | 11/1992 | Kinomoto . | |
| 5,209,467 | 5/1993 | Schmaling . | |
| 5,407,191 | 4/1995 | Ukai . | |

FOREIGN PATENT DOCUMENTS

| | | |
|---|---|---|
| 2-193838 | 7/1990 | Japan . |
| 3-8641 | 1/1991 | Japan . |

*Primary Examiner*—H. Grant Skaggs
*Attorney, Agent, or Firm*—Ralph E. Jocke

[57] ABSTRACT

A passbook transport and handling apparatus (10) for transporting a passbook between a customer using an automated banking machine and a printer (12) located inside the banking machine includes first belt flights (32) movable on first pulleys (22). The transport further includes second belt flights (34) movable on second pulleys (28). The second belt flights are disposed traversely intermediate of the first belt flights so that a passbook carried therein between is engaged firmly but with limited slippage. The passbook is guided through the transport by a first fixed edge guide (44). A second edge guide (46) is mounted on a spring (48) so as to bias the passbook into alignment as it passes through the transport. A gate member (72) is movable between positions blocking or admitting a passbook to the transport. Movement of the gate member as well as the belt flights is under control of a processor. Sensors (110), (114), (118) and (124) are operatively connected to and are controlled by the processor and prevent the admission and passage of improperly sized passbooks by the transport.

17 Claims, 21 Drawing Sheets

PASSBOOK TRANSPORT MECHANISM FOR AUTOMATED TELLER MACHINE

CROSS REFERENCE TO RELATED APPLICATION

This Application is a Continuation of application Ser. No. 08/589,094 filed Jan. 23, 1996 and now abandoned; which is a Divisional Application of application Ser. No. 08/258,040 filed Jun. 10, 1994, now U.S. Pat. No. 5,507,481.

TECHNICAL FIELD

This invention relates to automated banking machines. Specifically, this invention relates to a mechanism for handling and transporting a passbook between a customer operating an automated banking machine and a printer located inside the machine for printing information in the passbook.

BACKGROUND ART

Automated teller machines (ATMs) are well known in the prior art. Customers use ATMs to conduct a variety of banking transactions. These transactions may include making deposits to and withdrawals from accounts, paying bills and checking the status of various accounts.

Some banking transactions have not been performed by ATMs. For example, many people prefer to have the amount of their savings balance recorded in a passbook. Recording amount information in a passbook has generally required a human teller to input the transaction data and to align the passbook in a special printer so that the balance information may be printed in the proper location.

The automated handling of passbooks has proven to be difficult. This is because passbooks are usually fairly thick and are folded. Passbooks tend to skew when transported between conventional rollers or belts because a passbook usually has a different thickness on each side of the fold. This has made it difficult to handle a passbook with automated equipment. Passbooks also come in many different sizes. This has made it difficult to produce a single mechanism that is suitable for handling the wide range of passbooks that may be encountered.

It is also difficult to automatically align a passbook with a passbook printer using automated equipment. This is because the passbook pages may tend to become folded and/or caught. Automated handling of passbooks also presents unique problems because of different speeds between the printing mechanism which must firmly engage the passbook during printing and a transport apparatus that may be used to move the passbook. This may result in skewing or misalignment. Such problems result in incorrect positioning of the information which can render the passbook unusable.

Thus there exists a need for a mechanism for handling and transporting a passbook that can be used in an ATM to move a passbook from a customer, position it accurately for printing and then return it to the customer.

DISCLOSURE OF INVENTION

It is an object of the present invention to provide a transport apparatus for a passbook.

It is a further object of the present invention to provide a transport apparatus that can move a passbook between a customer and a printer inside an automated banking machine.

It is a further object of the present invention to provide a transport apparatus for handling and moving a passbook that aligns the passbook as it is moved.

It is a further object of the present invention to provide a transport apparatus for a passbook that verifies that the passbook that is presented is properly sized.

It is a further object of the present invention to provide a transport apparatus for a passbook that may be readily adapted to passbooks of various sizes.

It is a further object of the present invention to provide a transport apparatus for a passbook that is resistant to vandalism.

It is a further object of the present invention to provide a transport apparatus for a passbook that minimizes the risk of damage to the passbook.

It is a further object of the present invention to provide a transport for an item that carries the item in a properly oriented condition and which avoids skewing.

It is a further object of the present invention to provide a transport apparatus for an item that provides controlled frictional engagement and slippage so the item may be delivered to and from other pieces of equipment moving at different speeds.

It is a further object of the present invention to provide a method for transporting a passbook inside an automated teller machine.

It is a further object of the present invention to provide a method for aligning a passbook as it is transported.

Further objects of the present invention will be made apparent in the following Best Modes for Carrying Out Invention and the appended claims.

The foregoing objects are accomplished in the preferred embodiment of the invention by a passbook transport and handling apparatus located inside an automated teller machine. The transport apparatus receives a passbook through an entry slot from a customer who is operating the machine. The interior of the entry slot has a gate member and sensors adjacent thereto interiorally mounted in the machine. The sensors and gate enable only passbooks that are properly positioned and which have a desired width to be admitted to the transport through the entry slot.

The transport includes a plurality of first belt flights which extend parallel to one another and in a longitudinal direction. The longitudinal direction of the belts is the direction in which the passbook is transported into a printer mechanism that is located on an opposed side of the transport from the entry slot. A plurality of second belt flights extend generally parallel to the first belt flights but are positioned transversely in between the first belt flights. The first and second belt flights are preferably supported on first and second pulleys respectively at the ends of the transport and are otherwise unsupported. This construction provides for open areas adjacent each belt flight. The open areas run the length of the transport path and are sized to enable the thickest passbook section to pass therethrough. The first and second belt flights generally extend in a single horizontal plane or may be slightly offset. The belts provide an interwoven effect which holds the passbook between adjacent belt flights.

A pair of spaced edge guides extend in the longitudinal direction inside the transport parallel to the belt flights. The edge guides are positioned for engaging parallel spaced edge surfaces of a passbook. One of the edge guides is mounted in fixed relation to a frame of the apparatus. The other edge guide is mounted on a spring which operates to bias the passbook toward the fixed edge guide should the passbook become misaligned.

A passbook that enters the transport is admitted in the open, unfolded condition between the belt flights. Because the passbook includes a plurality of sheets and is open, the passbook will generally not be of uniform thickness across its open pages. The first belt flights engage the open pages which comprise a first side surface of a passbook and the second belt flights engage the opposed side surface of the passbook which is generally a cover. As the passbook is carried along by the belt flights, any misalignment is corrected by the biasing force of the spring and the edge guides. The passbook is transported without skewing.

The passbook exits the transport apparatus and is delivered to the nip rolls of the printing mechanism. The nip rolls hold the passbook in tightly gripped relation. The belt flights, because they are transversely disposed from one another, provide limited slippage and enable the belts to overrun without damage to the passbook. Once the printing is complete, the passbook is pushed out of the printer and again is moved to a position between the belt flights. The belts begin moving and provide limited slippage until the passbook is free of the printer and may be carried by the belts. The passbook is moved between the belt flights out the entry slot and back to the customer.

The passbook transport and handling apparatus includes sensors that sense the size of the passbook. The transport is operated under the control of a processor so that improperly sized passbooks that are input into the transport apparatus are returned to the customer. A gate member adjacent the entry slot of the transport apparatus also serves to protect the apparatus from acts of vandalism.

The passbook transport and handling apparatus is readily adjustable to accommodate passbooks of different sizes. Further, the transport apparatus of the present invention may be used for carrying other items such as sheets or stacks of sheets between its entry and exit ends.

BEST MODES FOR CARRYING OUT INVENTION

Figure 1:
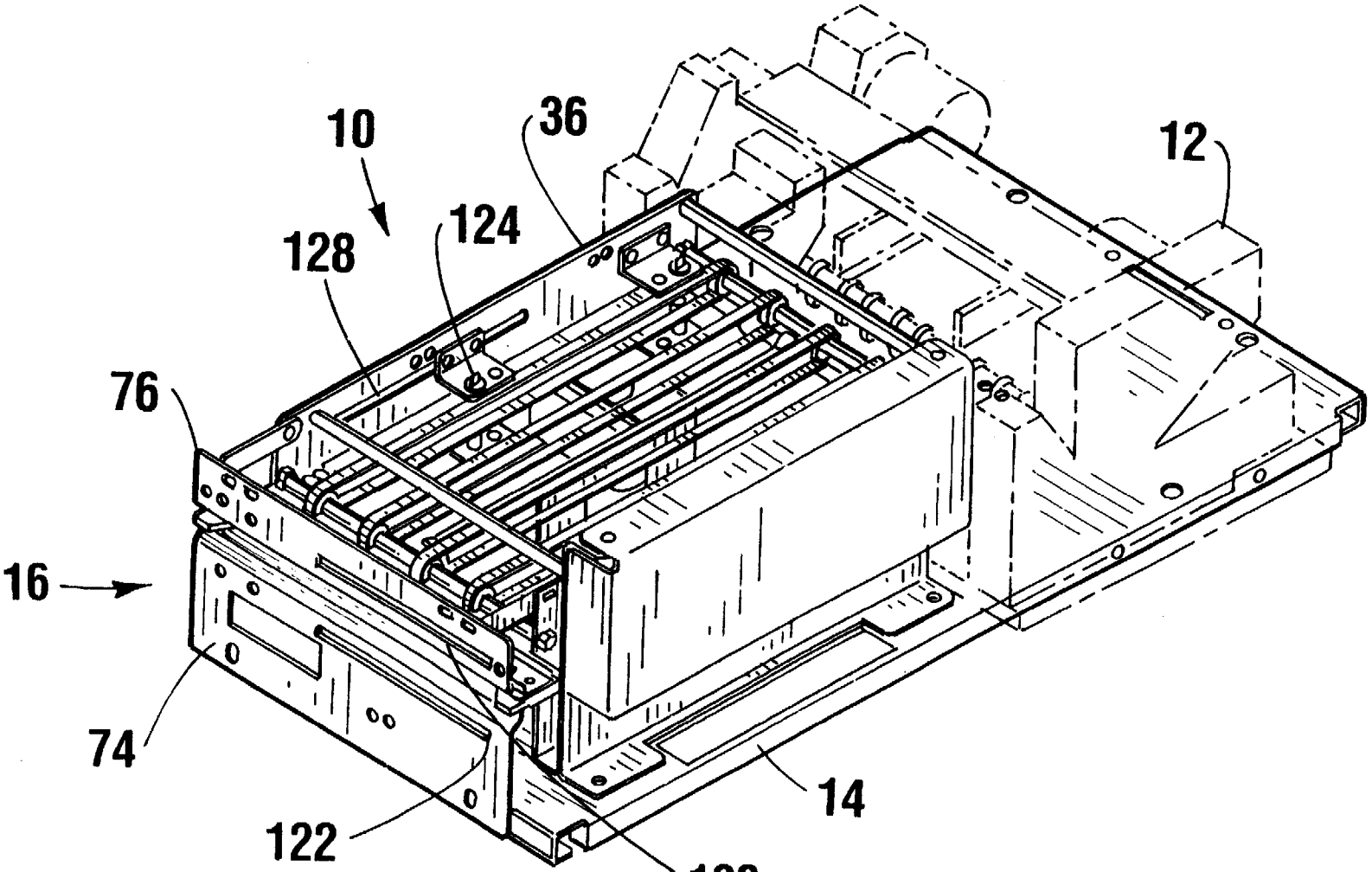
FIG. 1 is a right side isometric view of the passbook transport apparatus with a connected passbook printer mechanism shown in phantom.

Referring now to the drawings and particularly to FIG. 1, there is shown therein the preferred embodiment of the passbook transport and handling apparatus of the present invention generally indicated 10. The passbook transport apparatus is connected to a passbook printer 12 of a type that is known in the prior art. The passbook transport and printer are preferably positioned inside an automated teller machine which a customer may use to conduct banking transactions.

The transport 10 and printer 12 are mounted on a common base plate 14 which is positioned inside the automated teller machine. The passbook transport includes an entry end 16 which is adapted for receiving and delivering passbooks from a customer operating an automated teller machine through an opening in the facia of the machine. The transport further includes an exit end 18 (see FIG. 12) through which the transport mechanism delivers and receives a passbook to the connected printer.

Figure 3:
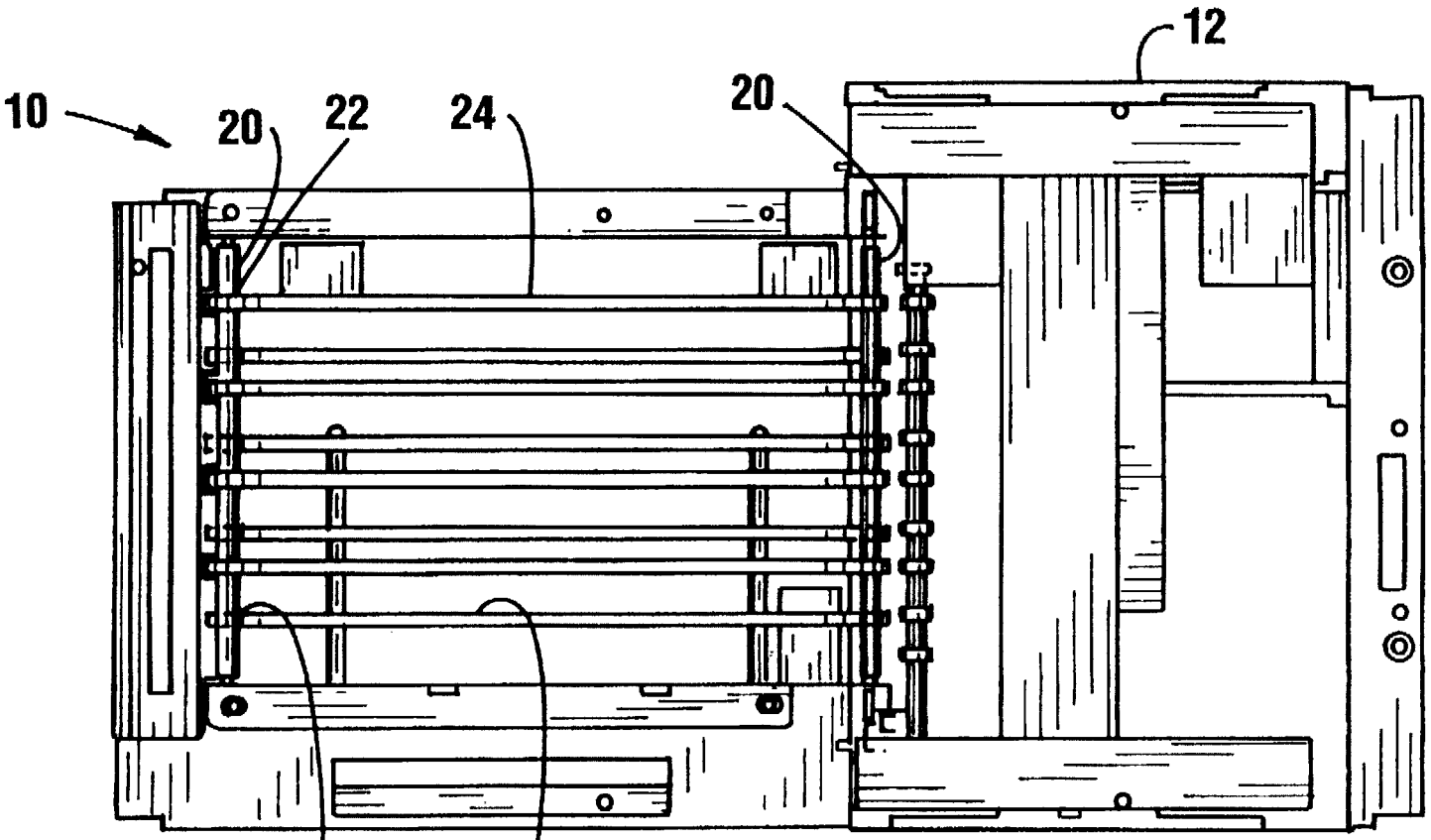
FIG. 3 is a top plan view of the passbook transport apparatus and an associated printer.

The transport apparatus 10 includes a pair of spaced first shafts 20 (see FIG. 3). A plurality of first pulleys 22 are mounted traversely spaced on first shaft 20. A plurality of first belts 24 extend between first pulleys 22. First belts 24 are elastic and first pulleys 22 are crowned pulleys so that the elastic action of the belts maintains them in centered relation on the pulleys.

Figure 4:
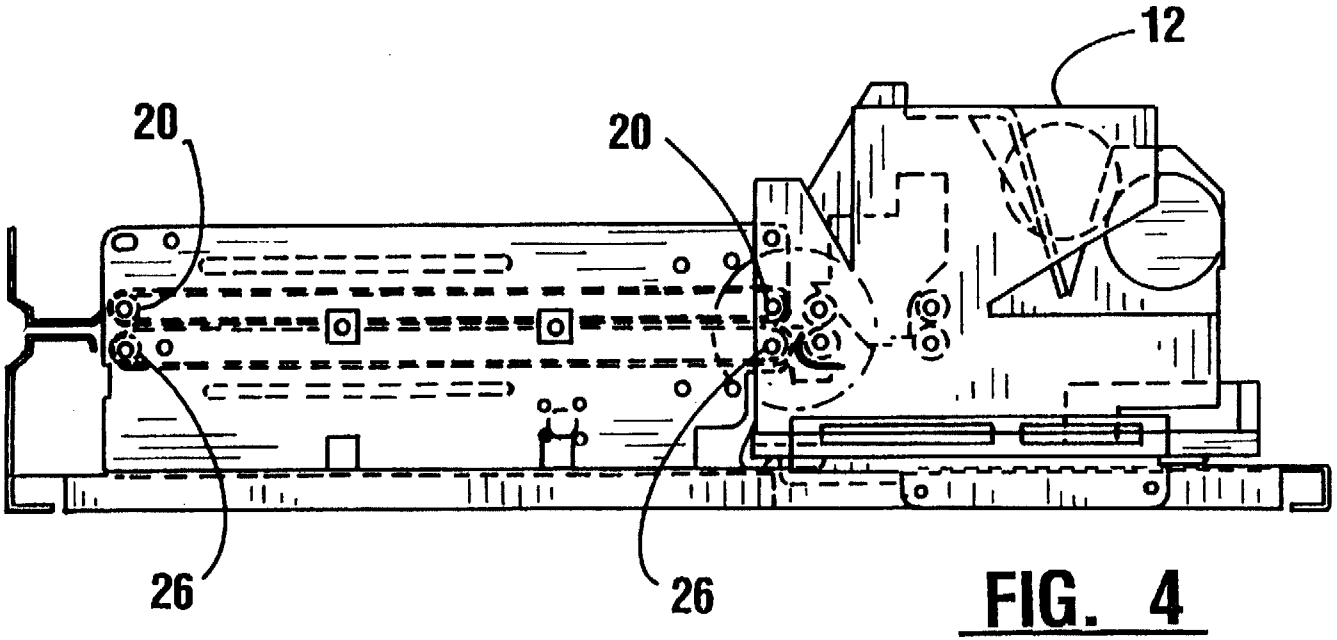
FIG. 4 is a right side view of the passbook transport apparatus and associated printer.

The transport apparatus 10 further includes a pair of spaced second shafts 26. The second shafts 26 are spaced vertically below the first shafts 20 (see FIG. 4). Second shafts 26 have mounted thereon a plurality of spaced second pulleys 28, which are crowned pulleys similar to first pulleys 22. A plurality of second belts 30 extend between second pulleys 28. Second belts 30 are elastic similar to first belts 24 so as to maintain a centered position on second pulleys 28.

In the preferred embodiment of the invention the first and second belts are TYPE SFT belts which are available from Belting Industries. The belts are preferably 6 millimeters in width. The crowned first and second pulleys are generally about the same width but are slightly wider than the belts, and are preferably 8 millimeters in width. By having the crowned pulleys slightly wider than the belts, the possibility of the belts tracking off the pulleys is reduced. This is because if a belt becomes sufficiently displaced from the center of the pulley and engages the vertical side wall of the pulley, the belt will tend to come off. By having the pulley wider than the belt, greater displacement is required before disengagement will occur. Rotation of the pulley tends to center the belt on the pulley so that a displacement is rapidly corrected. As a result, the belt remains on the pulley under varied service conditions.

Figure 2:
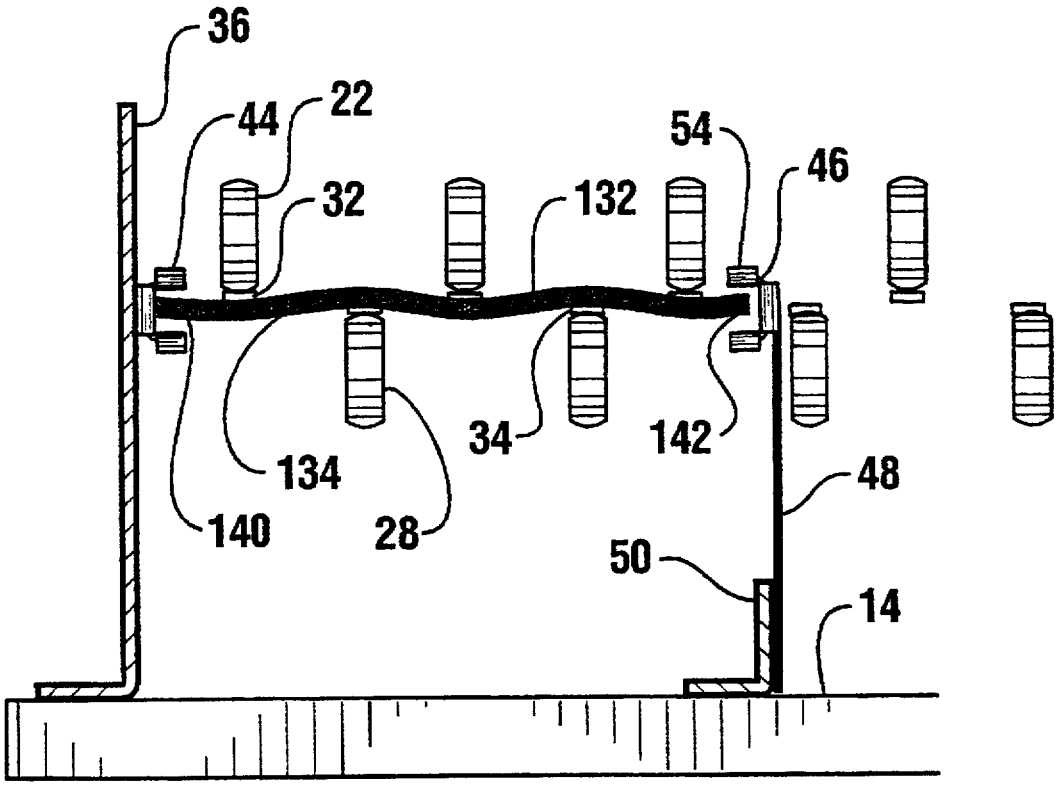
FIG. 2 is a cross sectional view through the passbook transport apparatus showing a passbook engaged between the belt flights.

As best shown in FIG. 2, second pulleys 28 are disposed intermediate of first pulleys 22. Shafts 20 and 26 are positioned such that first belt flights 32, which are the lower flights of first belts 24, and second belt flights 34, which are the upper belt flights of second belts 30, extend in a generally co-planer relationship for reasons that will be later discussed in detail.

Pulleys 22 are spaced transversely which provides an open area that extends between each adjacent pair of second belt flights 34. These open areas extend the entire length of the transport path. Likewise, pulleys 28 are transversely spaced so each adjacent pair provides a further open area that extends the length of the transport path. As shown in FIG. 2 each open area between an adjacent pair of belt flights 32 is associated in centered relation with a second belt flight 34. Likewise, each open space between a pair of adjacent second belt flights 34 is associated with an intermediate first belt flight 32. As a result, passbooks which are generally rigid but deformable in cross section, can be deformed without significant resistance from the usual flat condition to the configuration shown in FIG. 2. In this configuration the passbook is deformed so as to extend into the clearance areas.

The ability of a passbook to be deformed to extend into the clearance areas is a particularly advantageous aspect of the invention. This is because passbooks in the open condition generally have different thicknesses on each side of a central fold where the sheets are attached together. The construction of the present invention allows a maximum thickness of a suitable passbook to be deformed into the clearance areas along the entire length of the transport path. Force is applied to the passbook generally uniformly overall despite the variations in thickness on each side of the fold and despite different coefficients of friction between a passbook cover and the open sheets. This results in the passbook being transported in engaged relation with the belt flights without skewing.

The open areas of the preferred embodiment are sized to enable the maximum passbook thickness to pass therethrough without obstruction. The maximum passbook thickness is generally the thickness of the passbook when all the sheets are on the same side of the fold. To assure that the open areas of the transport are adequately sized, the radius of the pulleys beyond the support shafts are at least as great as the maximum passbook thickness. The pulleys are also generally about the same transverse width as the belt flights. The transverse spacing of the pulleys assures the adequacy of the open areas accommodating the maximum passbook thickness and enables the passbook to deform to move through the pulleys without significant resistance.

Figure 10:
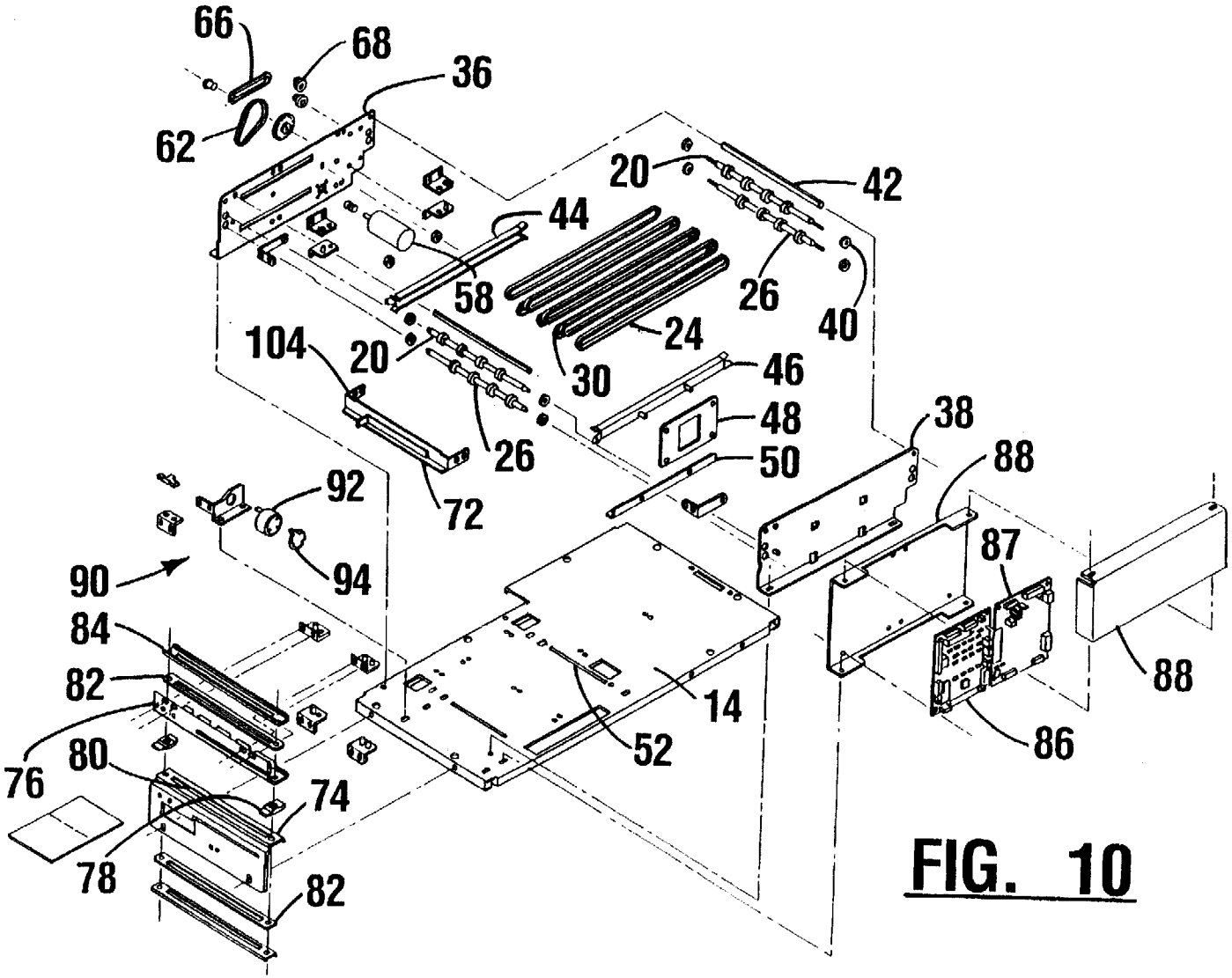
FIG. 10 is an exploded isometric view of the apparatus.

As shown in FIG. 10, the apparatus includes a pair of first and second upright spaced side walls 36 and 38, respectively. Side walls 36 and 38 each have a lower foot portion that attaches to base plate 14 using conventional fasteners. First and second shafts 20 and 26 are journaled in bearings 40 that are positioned in openings in the side walls. A pair of tie rods 42 extend between the side walls 36 and 38 and hold the side walls in properly spaced relation.

A first edge guide 44 is mounted to first side wall 36 (see FIG. 2). A second edge guide 46 is mounted in traversely disposed relation from first edge guide 44 and is positioned between one of the adjacent pairs of first and second belt flights 32 and 34, respectively.

Second edge guide 46 is mounted to a plate spring 48. Plate spring 48 is mounted at its lower side to an angle bracket 50. Angle bracket 50 is mounted to base plate 14 by fasteners that each extend through one of a pair of spaced, traversely extending slots 52 (see FIG. 10). Spaced slots 52 enable second edge guide 46 to be positioned at a selected distance from first edge guide 44. Both first and second edge guides 44 and 46 are generally "C" shaped in cross section and have tapered guide surfaces 54 at each end. The guide surfaces extend outward from each wall of the generally C-shaped edge guides to facilitate the entry of a passbook into the interior of the space bounded by the walls of the edge guide.

Figure 5:
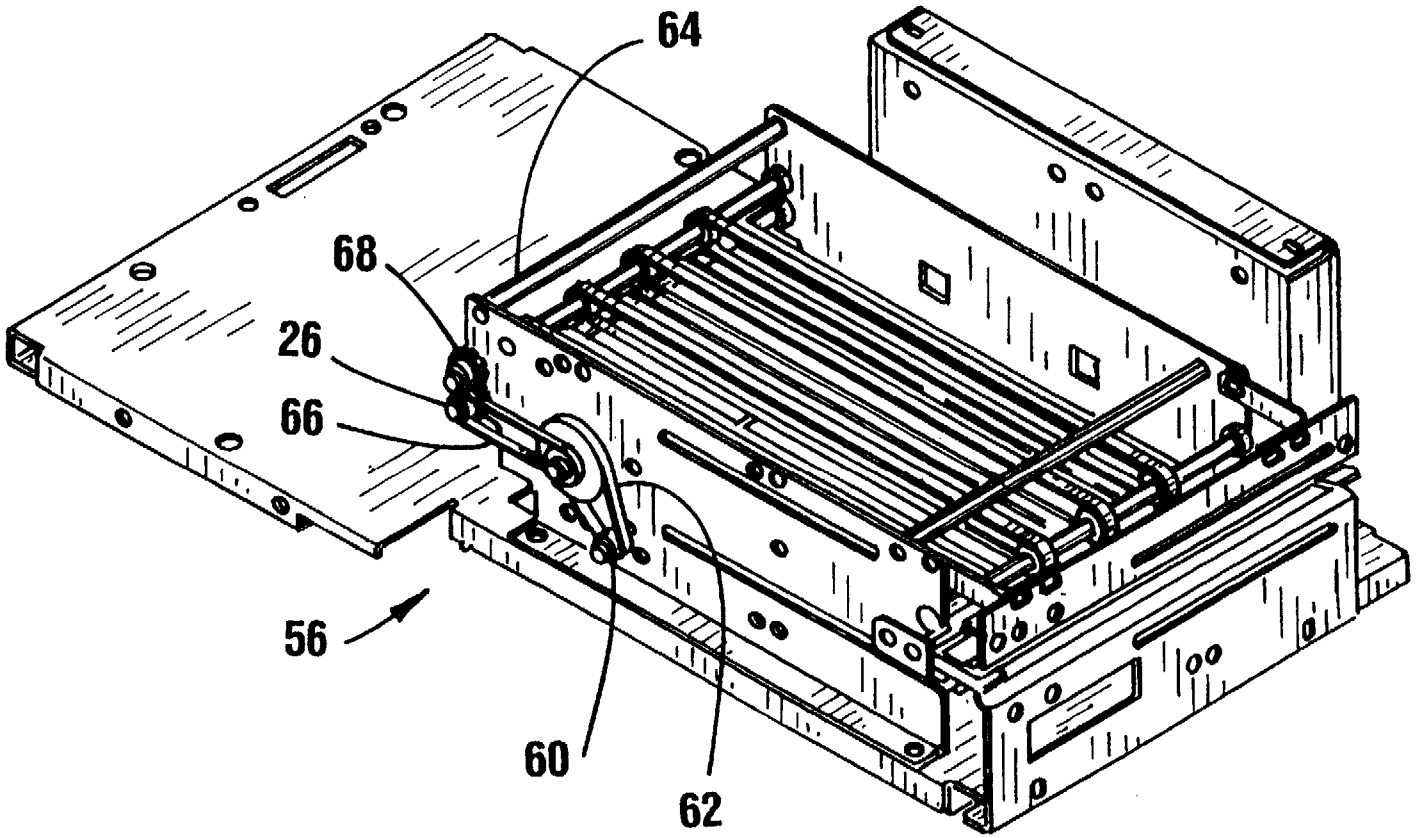
FIG. 5 is a left side isometric view of the passbook transport apparatus.
Figure 6:
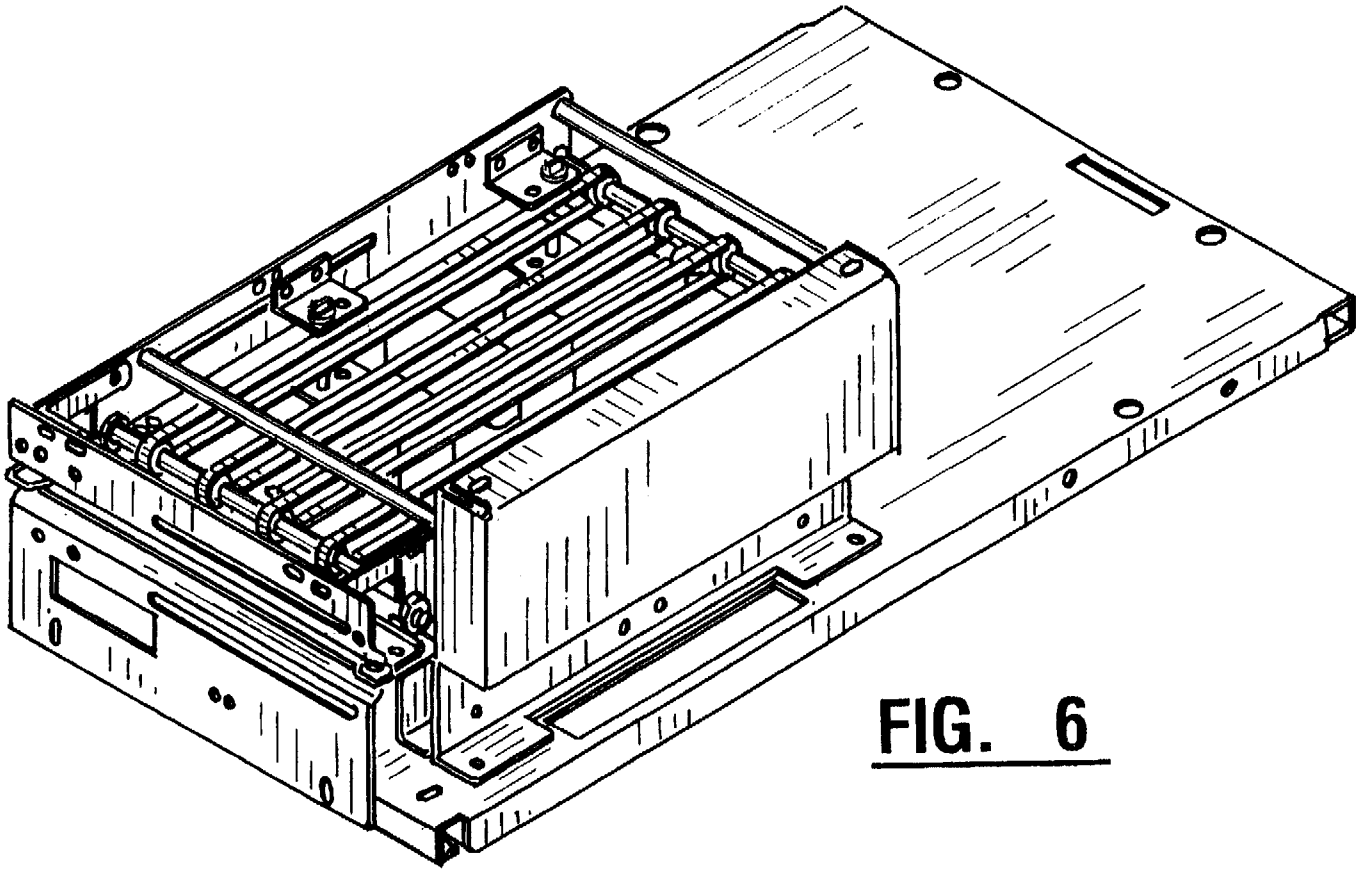
FIG. 6 is a right side isometric view of the transport apparatus.

First and second belts 24 and 30 are driven by a drive generally indicated 56. As best shown in FIGS. 5 and 10, drive 56 includes a D.C. electric motor 58 which is mounted to wall 36. Motor 58 has a drive shaft that has a pulley 60 mounted thereon. Pulley 60 drives a first drive belt 62 which rotates a double pulley 64 which is mounted for rotation on a pin that extends from wall 36. Double pulley 64 includes an inner pulley surface which is smaller in diameter than the outer pulley surface driven by first drive belt 62. Inner pulley surface drives a second drive belt 66 which in turn drives a pulley mounted on the second shaft 26 at the exit end of the transport. A pair of meshing gears 68 are mounted on the shafts 20 and 26 at the exit end. Drive 56 serves as a speed reducer and enables motor 58 to drive the first and second belts of the transport. Motor 58 is a reversing motor so that it can rotate in either direction and thus move the belts of the transport in either direction and at several speeds.

Figure 12:
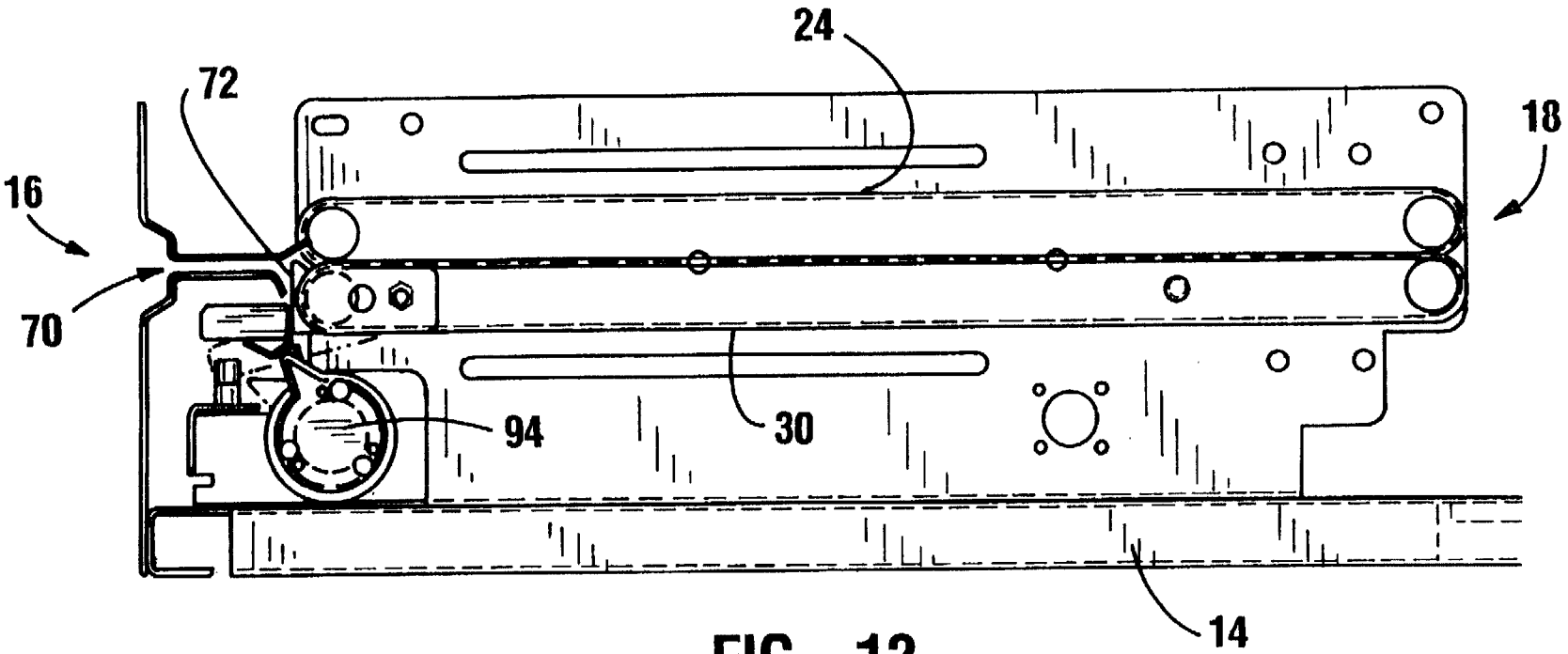
FIG. 12 is a right side cross sectional view of the passbook transport apparatus showing the entry gate member.

As best shown in FIG. 12, entry end 16 includes an entry slot 70 through which passbooks may be moved. As later discussed in detail, a gate member is movable to selectively block the entry slot or enable a passbook to pass through the entry slot and enter an entrance area, wherein a passbook can engage the first and second belts. The entry slot 70 is bounded by a lower front panel 74 and an upper front panel 76. The panels are maintained in spaced relation by a pair of spacers 78. The front panels 74 and 76 have traversely elongated slotted openings 80 therein which bound each side of the entry slot. Transparent lenses 82 are positioned in slot 80. Lenses 82 extend in slots 80 to prevent the accumulation of dirt or other material therein. Slotted backing brackets 84 hold the lenses 82 in position. As later discussed in detail, lenses 82 enable infrared sensors to sense the position of a passbook in the entry slot.

As shown in FIG. 10, the passbook transport also includes a processor board 86 and an input/output (I/O) board 87. The processor and I/O boards are mounted in a two piece enclosure 88 which is mounted to side wall 38. The processor board 86 includes a processor and a memory and is electrically connected through the I/O board to other components of the passbook transport in a manner later discussed in detail.

Figure 14:
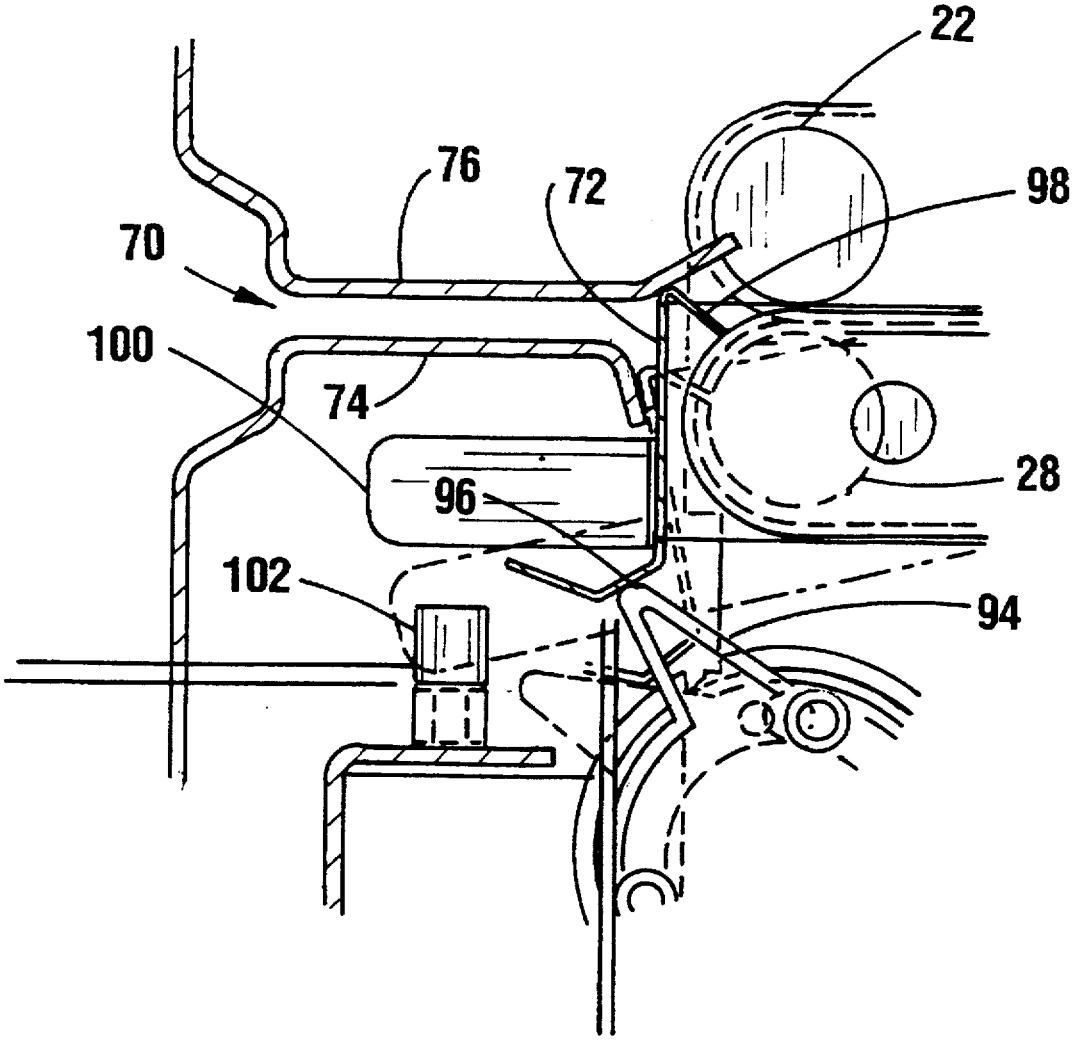
FIG. 14 is a partial cross sectional view of the passbook transport apparatus showing the gate member in the closed position with the open position shown in phantom.
Figure 15:
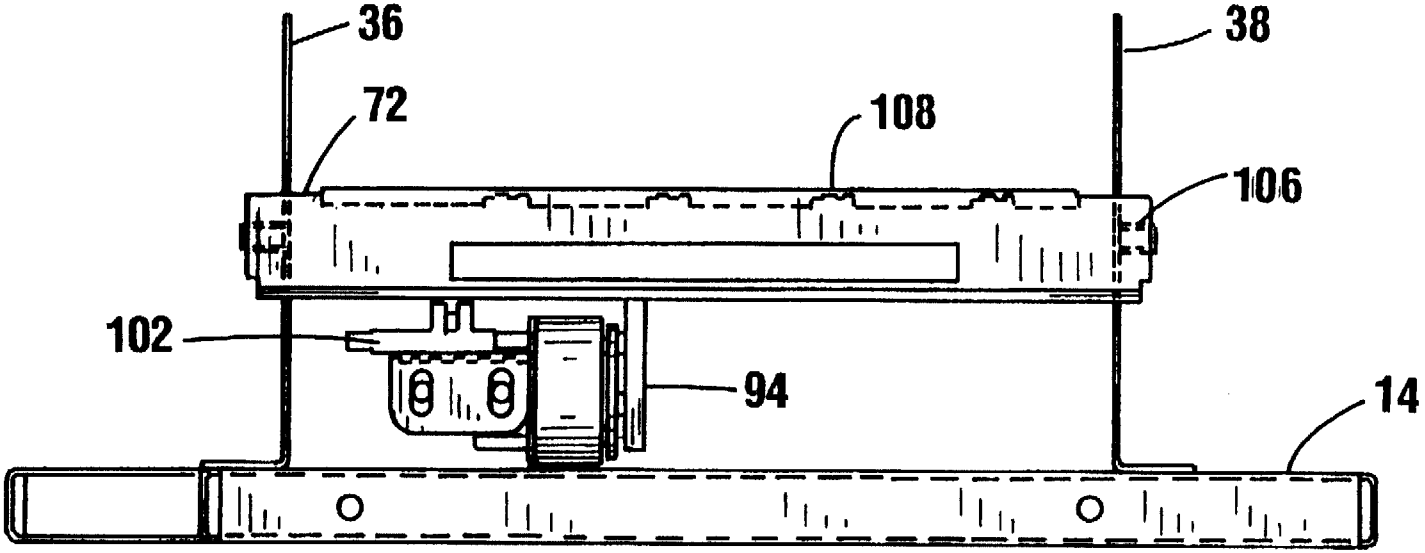
FIG. 15 is a partial front cross sectional view of the passbook transport apparatus with the gate member and the actuating mechanism for the gate member shown in the closed position.
Figure 16:
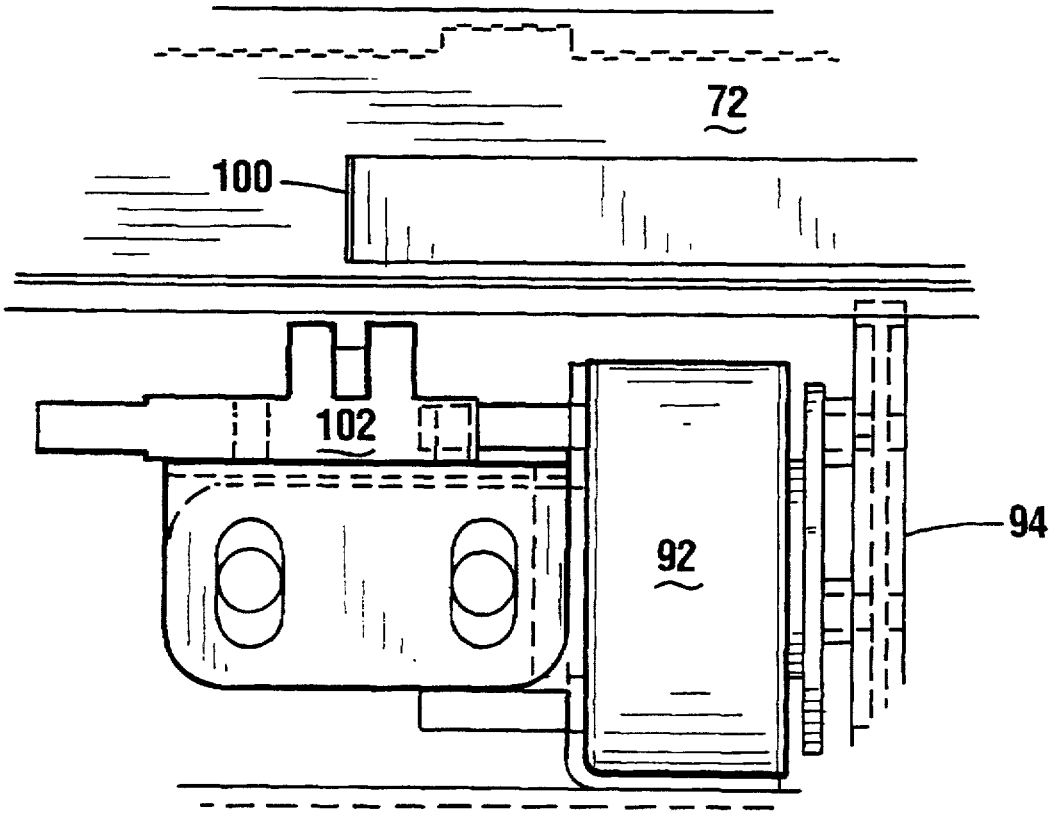
FIG. 16 is an enlarged partial front cross sectional view showing the gate member in the closed position.

Gate member 72 is moved between the open and closed positions by an actuating assembly generally indicated 90. The gate actuating assembly 90 includes a rotating solenoid 92 (see FIG. 15). The rotating solenoid 92 has an actuator which is connected to a locking cam 94. As shown in FIG. 14, the gate member 72 has a generally "S" shape in cross section and includes a lower cam follower portion 96 which is engaged with the locking cam 94 in the closed position of the gate member 72.

The gate member 72 includes an upper folded edge 98. Folded edge 98 engages an inner surface of the upper front panel 76 in the closed position of the gate member. In the open position folded edge 98 provides a guiding surface for guiding a passbook into and out of the space between the upper and lower front panels. The gate member 72 further includes a vane 100. Vane 100 is sized to be accepted within the slot of a photosensor 102 when the gate member 72 is in open position, which is shown in phantom in FIG. 14. In the preferred embodiment of the invention, sensor 102 is a Honeywell Model HOA7720-M22.

Figure 13:
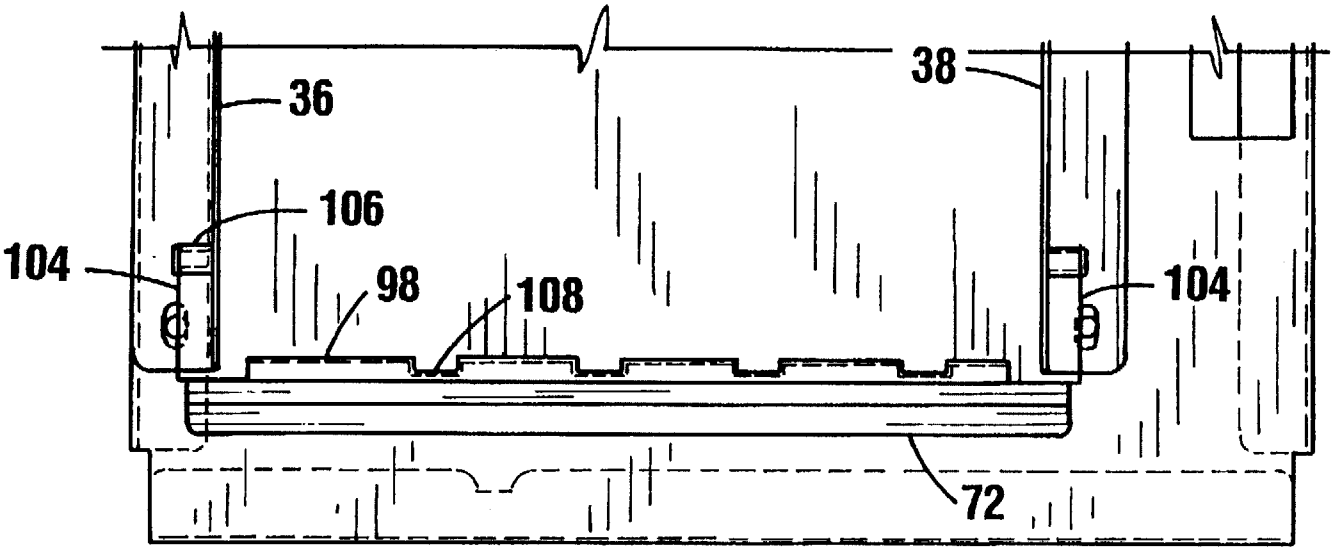
FIG. 13 is a partial top view of the passbook transport apparatus and gate member.

As shown in FIG. 13, gate member 72 includes a pair of longitudinally extending legs 104. Legs 104 are rotatable on pins 106 which extend from the side walls 36 and 38. Folded edge 98 of member 72 includes cutouts 108. Cutouts 108 are configured to enable member 72 to move downward to the position shown in phantom in FIG. 14 and allow the entry slot 70 to be open to the entrance area wherein a passbook can engage the belts. The cutouts 108 are positioned traversely along folded edge 98 so that second pulleys 28 are accepted in the cutouts when the gate member is in the open position.

Figure 7:
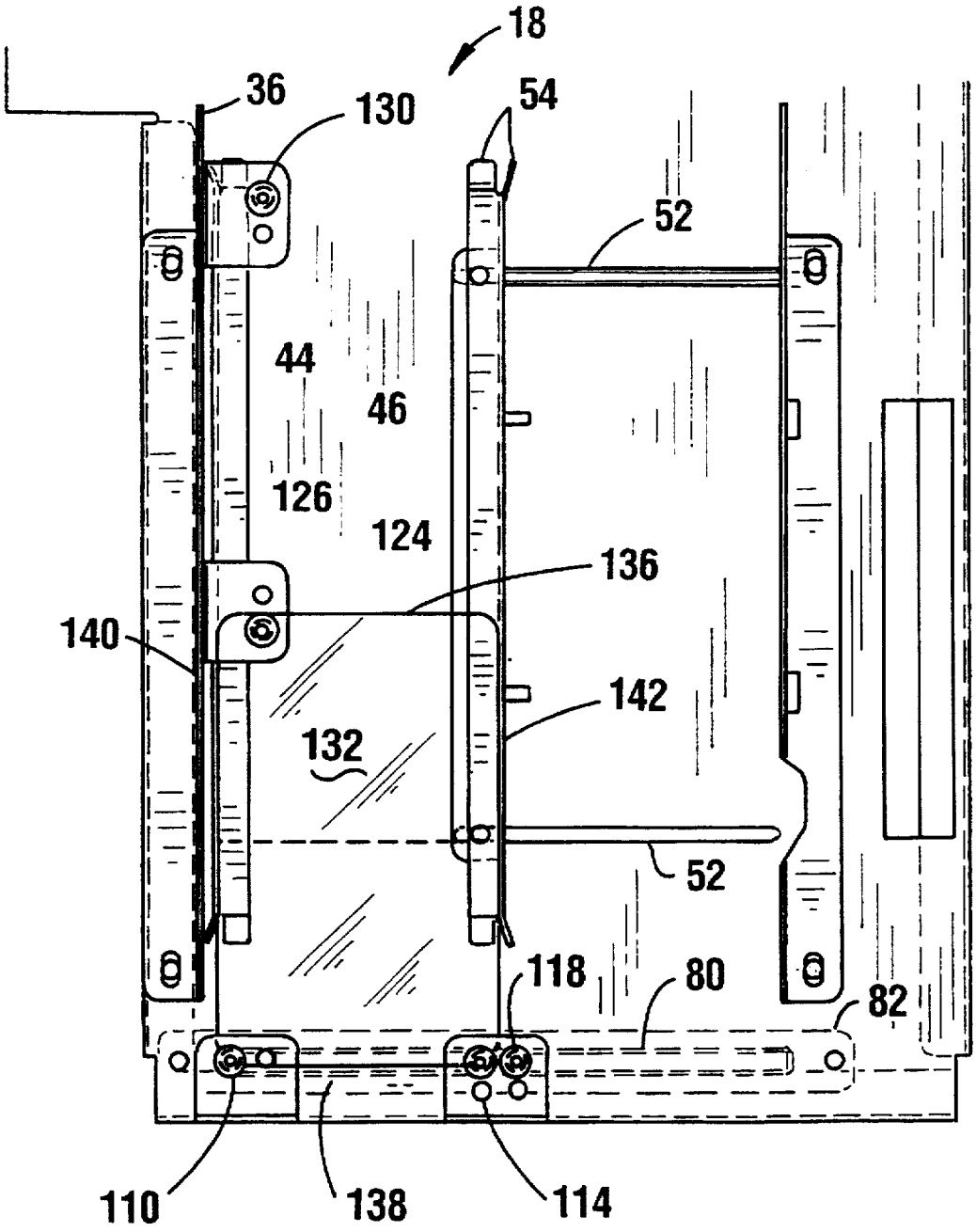
FIG. 7 is a partial top view showing the transport apparatus with a passbook positioned therein.
Figure 8:
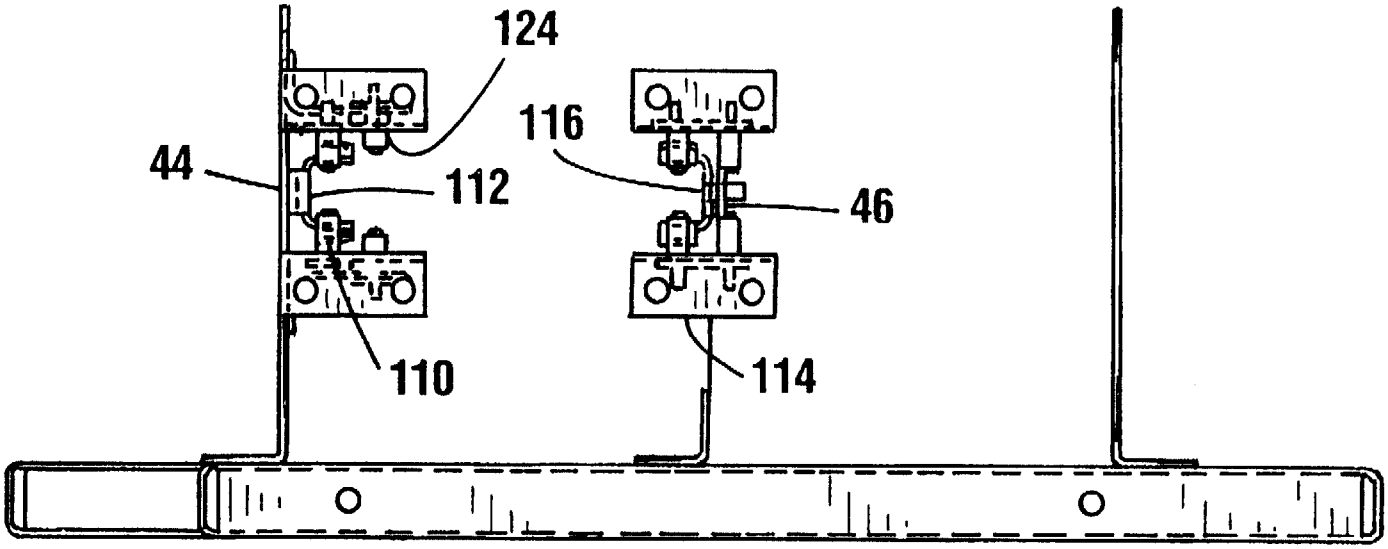
FIG. 8 is a partial cross sectional view through the transport apparatus showing the edge guides and sensors of the apparatus.
Figure 9:
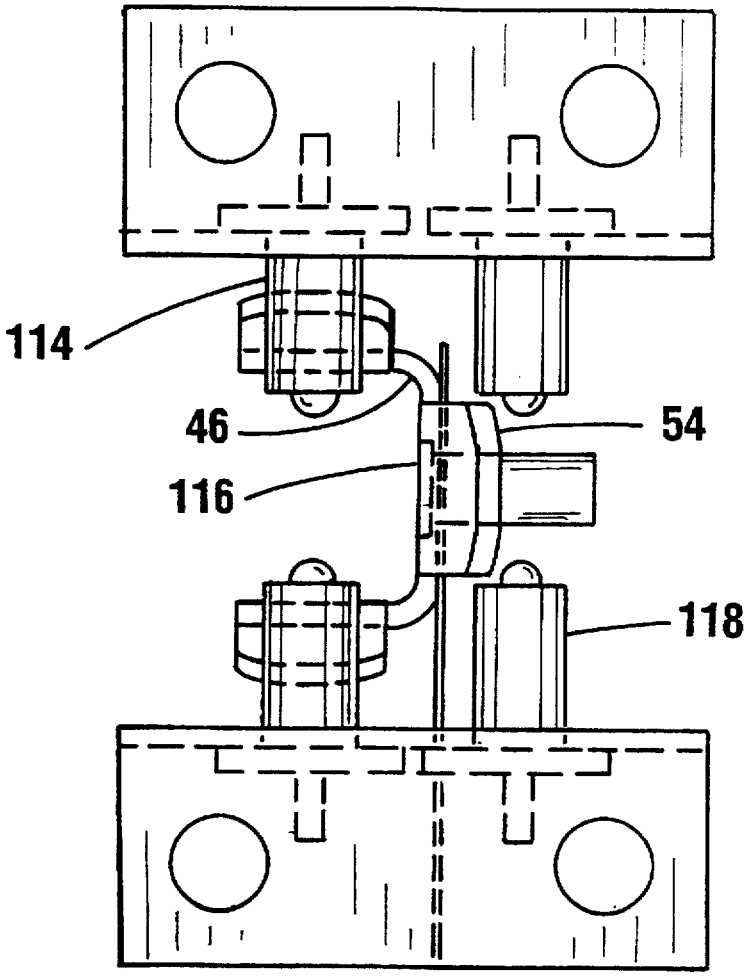
FIG. 9 is an enlarged view of the movable edge guide and sensors of the apparatus.

As best shown in FIG. 7, a left edge or first infrared sensor 110 is mounted across the entry slot 70 adjacent to side wall 36. First sensor 110 is of conventional construction and includes an infrared transmitter and receiver. The sensor is in alignment with slotted openings 80 and is enabled to sense through the lenses 82 which extend in the slots. First sensor 110 is adjacent a first edge guide surface 112 of first edge guide 44 (see FIG. 8). In the preferred embodiment sensor 110 is spaced inwardly from the first fixed edge guide about 7 millimeters.

A width or second sensor 114 is positioned in traverse alignment with first sensor 110. Second sensor 114 is also an infrared sensor of the conventional construction having a transmitter and receiver that senses by transmission of light through slots 80 and lenses 82. Second sensor 114 is generally adjacent a second edge guide surface 116 of second edge guide 46, and is spaced about 7 millimeters inwardly therefrom.

A wide document or third sensor 118 is disposed slightly further in the traverse direction from second sensor 114. Third sensor 118 also includes a transmitter and receiver that senses through slots 80 and lenses 82. Third sensor 118 is positioned slightly outward from the outer edge of the front guide surface 54 of second edge guide 46 by about 7 millimeters.

Second sensor 114 and third sensor 118 are mounted in snap-in fashion to brackets which are held by fasteners in traversely extending sensor mounting slots 120 and 122 which extend in the upper and lower front panels 76 and 74, respectively.

The passbook transport and handling apparatus further includes a length or fourth sensor 124 that is disposed in a longitudinal direction from first sensor 110. Fourth sensor 124 includes a transmitter and receiver, each of which is mounted on a bracket 126. Brackets 126 are longitudinally movable in slots 128 in first side wall 36. As later explained, fourth sensor 124 enables the passbook transport of the present invention to be adopted for use with passbooks of various sizes.

A document present or fifth sensor 130 is mounted in the passbook transport adjacent to the passbook printer 12. Fifth sensor 130 enables the transport of the present invention to sense the passage of a passbook to and from the printer 12 in a manner later explained.

All of sensors 110, 114, 118, 124 and 130 are preferably infrared sensors. In the preferred embodiment each sensor includes a Model SFH 409-2 emitter and a Model SFH 309-F-3 detector available from the Siemens Company. The detectors preferably include a filter so they are not susceptible to false signals from other light sources.

In operation, a passbook in which printing is to be conducted is presented by the customer to the automated teller machine in which the passbook transport and printer mechanism is mounted. The passbooks with which the present invention is designed to be used are the conventional design which are folded in the closed position. The passbooks are comprised of multiple sheets and/or pages. They generally include a cover which is comprised of a material having somewhat different properties from the passbook pages.

Before insertion of the passbook into the transport of the present invention, the passbook is unfolded to the open position. In this position the passbook presents a first upper generally planer side or surface 132 and a lower second generally planer side or surface 134 (see FIG. 2). Both first and second side surfaces 132, 134 extend across the center fold of the passbook.

The passbook also has a leading edge 136 which is the edge presented first into the transport and a trailing edge 138 (see FIG. 7). The passbook further includes a first side edge surface 140 and a parallel traversely disposed second side edge surface 142.

When a customer presents their passbook to the machine, it is extended through the opening in the machine facia and enters the entry slot 70. With no passbook in the transport, the gate member 72 is maintained closed by the engagement of the locking cam 94 with the cam follower surface 96 on the gate member. The I/O board and processor are connected to the sensors and control the motor and gate member. The gate member will not open unless the passbook is positioned so as to block first sensor 110 and second sensor 114, without also blocking third sensor 118. These three sensors are positioned to insure that only a passbook having the proper width will be admitted to the transport. If the passbook is positioned and sized to block sensors 110 and 114 but not 118, the rotating solenoid 92 is actuated by a signal from the processor to rotate the locking cam 94 to disengage the gate member 72. When this occurs, the gate member falls to the position shown in phantom in FIG. 14. This enables the passbook to move through the entry slot 70 and to an entrance area adjacent the gate wherein it can engage the first and second belts 24 and 30, respectively.

Upon opening of the gate member 72, the vane 100 on the gate member moves to be accepted into sensor 102. This provides a signal to the processor board and indicates that the gate is in open position. Upon the sensing of a passbook that is the proper width, (i.e., blocks sensors 110 and 114, but not 118) the processor also operates to generate a signal to start motor 58 which causes belts 24 and 30 to begin moving in a forward longitudinal direction such that the first belt flights 32 and second belt flights 34 will tend to engage and pull the passbook into the area between the belts. As best shown in FIG. 2, the co-planar positions of the first and second belt flights cause the passbook to be "woven" and carried between the belt flights in a manner that holds the passbook while still providing limited slippage. This is very significant as the belt flights are enabled to overrun the movement of the passbook without causing any damage thereto.

As shown in FIG. 2, the co-planar position of belt flights 32 and 34 cause the passbook engaging face surface of the lower belt flight to be located above the passbook engaging face surface of the upper belt flight. The offset between the face surfaces is equal to the thickness of the belts. This works satisfactorily for many passbooks as they are generally sufficiently flexible in cross section to be deformed in to the open areas adjacent each belt flight without significant resistance. This avoids areas of high applied force or "pinching" and enables the passbook to be transported along the transport path without skewing.

For transporting thicker or more rigid items, it may be desirable to have the face surfaces at the same level or spaced apart. Likewise, for thinner, more flexible items, it may be desirable to have the face surfaces with a greater offset to increase the "woven" effect. In other embodiments the lateral distance between the belts and the pulleys can be made variable to ideally adjust to the nature of the item carried. This can be done automatically by incorporating a thickness sensor into the device and moving the belts apart according to the thickness sensed. This enables the transport to be tailored to exactly the thickness of the item being carried.

Upon entry of the passbook between the belt flights, the first and second side edge surfaces 140 and 142 of the passbook engage the first and second edge guides 44 and 46, respectively. The tapered guide surfaces 54 at the front and back ends of the edge guides facilitate the passage of the edge surfaces into the interior of the "C" shaped edge guides. The second edge guide 46 on plate spring 48 operates so that if the passbook is misaligned due to improper alignment during insertion or otherwise, the deflection of spring 48 provides a biasing force that tends to move the passbook back into proper engagement with first edge guide 44. This construction is significant because it enables alignment of the passbook without the application of excessive force which may cause damage thereto. Further, the gentle aligning action of the spring force on the second edge guide enables the gradual correction of any misalignments that may occur during transport of the passbook. Once properly aligned the transport construction of the invention carries the passbook in engaged relation with the belt flights without skewing.

The processor associated with the passbook transport drives the first and second belts to move the passbook into the transport to the position shown in FIG. 7 wherein the leading edge 136 of the passbook is sensed by fourth sensor 124. In this position, sensors 110, 114 and 124 are all in sensing relation with the passbook momentarily. The processor on the processor board 86 is programmed so that if sensor 118 is blocked at any time while the passbook is moving into the transport toward sensor 124, the direction of the motor will be reversed and the passbook will be returned to the customer.

The processor is also programmed so that if sensor 110 becomes unblocked and sensor 124 is not blocked, as would be expected for a properly sized passbook, the processor which serves as means for reversing the direction of the motor, reverses the motor direction. The motor 58 is run in the reverse direction until the passbook is returned out the entry slot 70 to the customer. It is determined that the passbook is back in the entry slot through the signals from sensors 110, 114. This prevents acceptance of a passbook that is the correct width but is "too short."

Alternatively, the processor may be programmed so that if the sensors 110 and 114 should continue to sense the passbook beyond the sensing thereof by sensor 124, the direction of motor 58 may be reversed so as to return the passbook out the entry slot 70 to the customer. This prevents entry of a passbook that is "too long."

Figure 11:
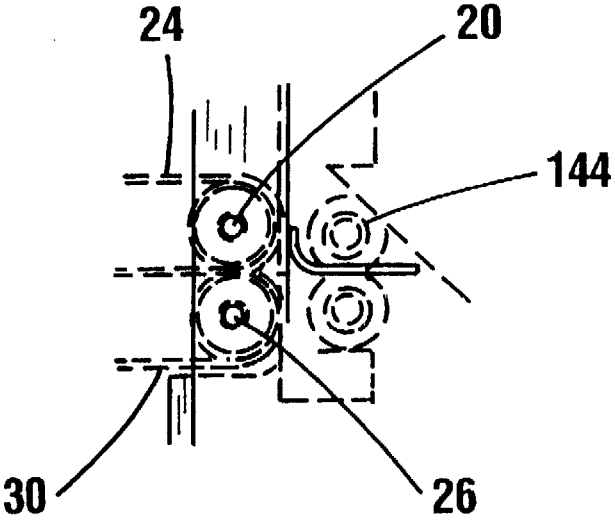
FIG. 11 is an enlarged view of the exit end of the passbook transport apparatus and the passbook engaging rolls of the printer mechanism.

If the passbook is the proper size, the gate will close once the passbook has unblocked sensor 110. The passbook will pass through the transport to the exit end 18 wherein it will be sensed by sensor 130. Sensor 130 actuates the passbook printer 12 to prepare to begin operation. The processor also responds to sensor 130 to slow down the motor. The motor slows to move the passbook at a speed that is slightly slower than the speed at which the printer will move the passbook once it is engaged therewith. As shown in FIG. 11, the printer 12 includes a plurality of adjacent nip rolls 144 which hold the passbook firmly therein for purposes of accurately moving the passbook so as to place printing the on the next available line.

As the passbook is moved by the first and second belts 24 and 30 into the nip rolls 144, the processor controls the motor 58 so that the belts overrun until the passbook is securely engaged by the nip rolls. The engagement of the passbook by the printer causes a signal to be generated which is received by the processor. The processor then operates to shut the motor off. The passbook is thereafter moved by the nip rolls of the printer.

As previously discussed, because of the spaced relation of the belts, they are enabled to overrun on the passbook without causing any damage thereto. Likewise, after the printer 12 has printed in the passbook and begins to move it through the nip rolls 144 back between belts 30 and 24, the processor receives a signal from the printer and in response motor 58 is started in the reverse direction to urge the passbook in the reverse direction back towards the entry slot 70. The processor also opens the gate member 72. If the processor fails to receive a signal from sensor 102 that the gate is open, the processor stops the belts. As the printer is returning the passbook to the transport, the belts are operated at a slow speed so as to overrun on the passbook until the nip rolls 144 disengage the passbook. The speed of the belts in this condition is slightly faster than the speed of the passbook coming out of the nip rolls.

Upon disengagement of the nip rolls 144 of the printer, the passbook is carried between the first and second belt flights in the manner shown in FIG. 2 back to the entry end 16 of the transport. In an alternative embodiment, if the passbook does not reach the first sensor 110 within a time set by the program which operates in the processor, the motor increases speed. This is effective for freeing a passbook that has become stuck in the transport. Once the passbook reaches sensor 110 the motor shuts off after a time delay which ensures the passbook is extending from the fascia of the machine where a customer may retrieve it.

In another alternative embodiment, once the passbook clears the nip rolls of the printer, the sensor 130 sends a signal to the processor. In response the processor causes the motor to increase speed as it carries the passbook out the entry slot to the customer. This can help the transport shorten the return time.

The processor is also operative to execute a computer program in firmware which functions to detect fault conditions and to assure that only properly sized passbooks are admitted to the transport. The processor is also operative to extend the life of the infrared sensors, by shutting off the emitters when the sensors are not in use.

Figure 17:
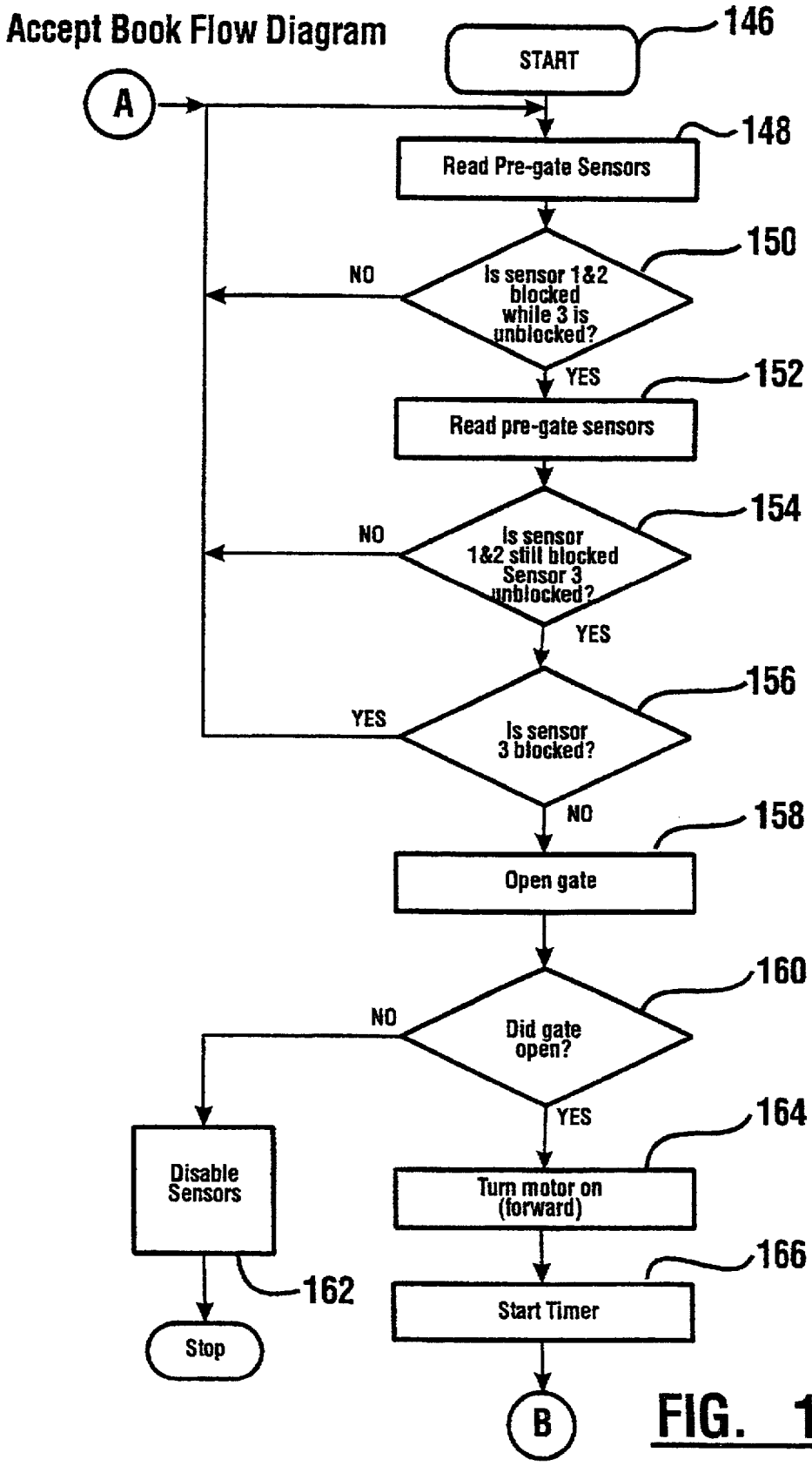
FIGS. 17 through 21 are flow charts of the program executed by the processor which controls operation of the transport apparatus.
Figure 18:
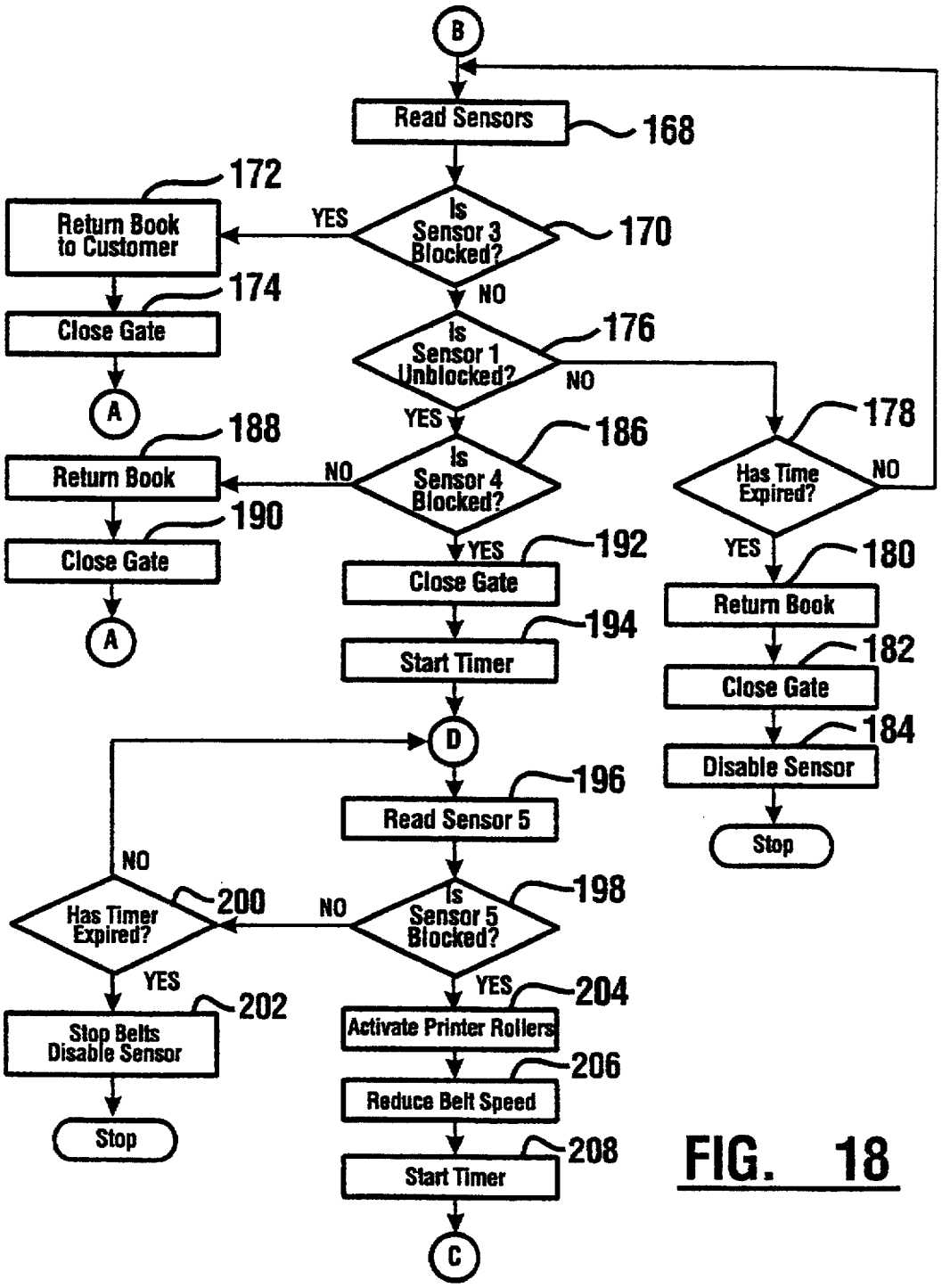
Figure 19:
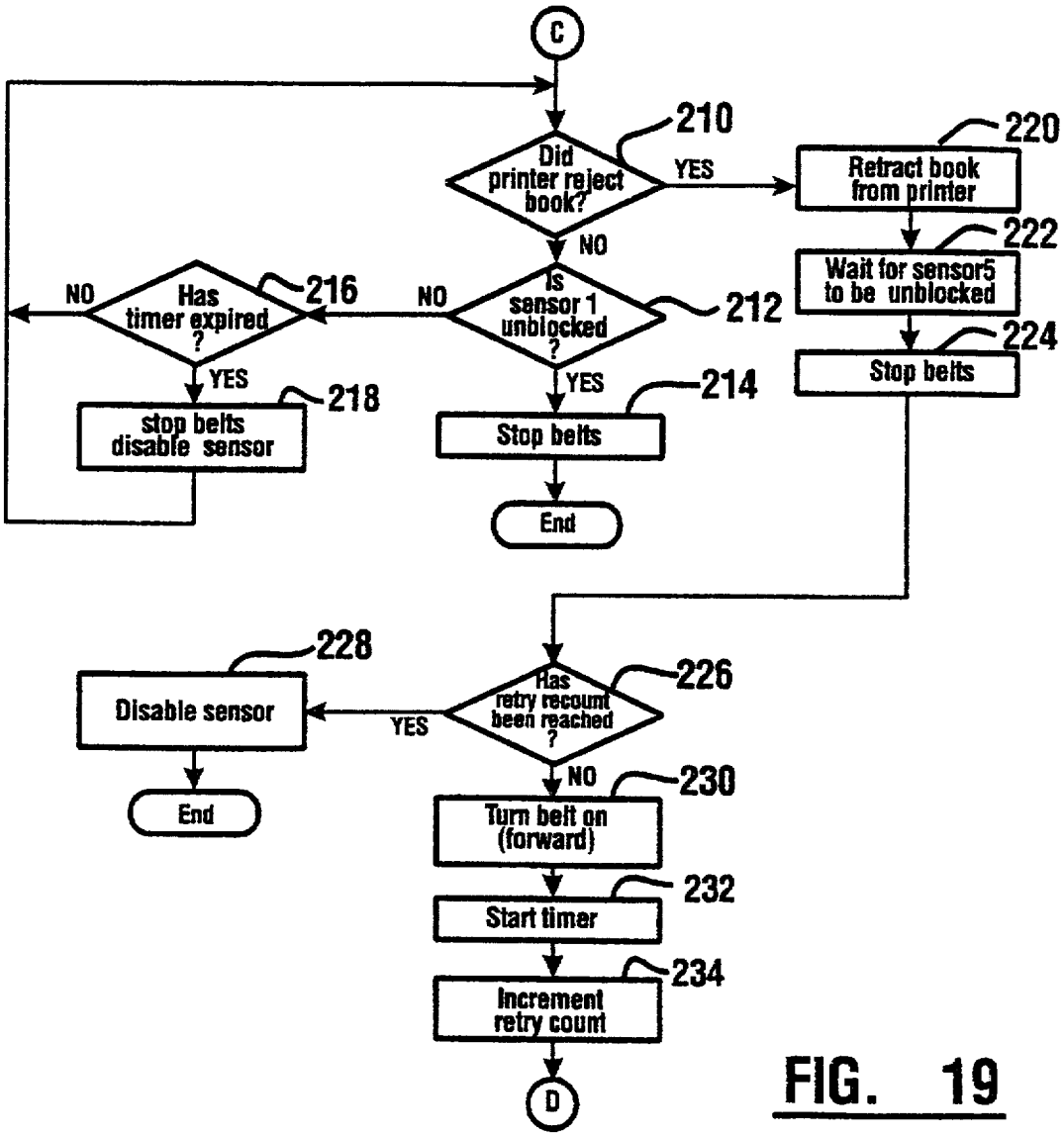

The program executed by the processor of the preferred embodiment of the invention is shown in FIGS. 17–21. As shown in FIG. 17, the transport is made operative through a customer indicating that they intend to present a passbook to the automated teller machine. This is normally done by the customer pushing the appropriate key or other input device on the automated teller machine. This activates the transport mechanism at a step 146. The processor first operates to turn on the emitters of the infrared sensors.

The processor then "reads" the conditions of the first, second and third sensors 110, 114 and 118 at a step 148. The processor then decides if the passbook being presented is properly positioned and the proper width by blocking sensors 110 and 114, but not 118, at a step 150. If this condition is not satisfied the program returns to step 148. If the passbook appears correctly sized, a second read check of the sensors is made at step 152. A decision is again made at 154 if the passbook is properly sized. A further check to see if the passbook is over width and a check for blocking sensor 118 is made at step 156. If the passbook appears to be the correct width and is properly positioned, the gate member 72 is opened at a step 158.

The sensing of gate member 72 opening based on signals from sensor 102 is checked at step 160. If the gate did not open the sensors are shut off at a step 162 and a fault condition is indicated. If the gate opens properly the processor starts the motor to begin moving the belts at a step 164. As the belts start moving, the processor also begins a timing routine at step 166. The timing routine 166 operates to verify that the passbook properly enters the transport as hereafter explained.

As the passbook moves into the transport, the processor continues to read sensors 110, 114 and 118 at step 168. Sensor 118 is monitored and if it becomes blocked at step 170, which suggests a problem with the size or shape of the passbook, the processor operates to reverse the motor to return the passbook to the customer at step 172 and to close the gate at step 174. The customer is then free to reinsert the passbook.

If sensor 118 is not blocked as the passbook moves into the transport, the processor waits for sensor 110 to become unblocked at step 176. If the sensor has not unblocked, the processor will see if timing routine 166 has timed out at step 178. If not, the processor returns to step 168. However, if the timer has expired there is a problem. In that case the processor reverses the direction of the motor to return the passbook at step 180 to return the book to the customer. The gate is then closed at step 182 and the sensors shut off at step 184.

If sensor 110 unblocks at step 176 before timing routine 166 expires, the processor checks to see if sensor 124 is blocked at step 186. If not, the passbook is "too short" and the steps 188 and 190 are executed to reverse the motor, return the book to the customer and close the gate. If sensor 124 is blocked as sensor 110 becomes unblocked then the passbook is of sufficient length and the processor closes the gate member at step 192.

The closing of the gate commences a timing routine 194. The processor reads sensor 130 at step 196 and looks for it to sense the passbook at step 198. A check is made at step 200 if timing routine 194 has timed out before the passbook is sensed at sensor 130. If so the transport is stopped and shut off at step 202.

If the arrival of the passbook adjacent sensor 130 is sensed within the permitted time, the nip rolls on the printer at the end of the transport path are started moving at step 204. Thereafter the processor slows the motor to reduce the forward speed of the passbook at a step 206 to slightly less than the linear speed of the nip rolls of the printer.

As the belts of the transport slow, the processor institutes another timing routine 208. The printer generates signals once the passbook is in its nip rolls. These signals indicate whether the printer has accepted the passbook and it is being held in its nip rolls or whether the printer has rejected the passbook and has failed to accept it into the nip rolls.

At step 210 it is checked whether the printer has sent a signal rejecting the passbook. If not, the processor looks for an acceptance signal from the printer at step 212. If the passbook has been accepted, then everything has worked properly and the processor stops the belts at step 214.

If there has been no rejection of the passbook at step 210, but the printer has not accepted the passbook at step 212, a check is made at step 216 to determine if timing routine 208 has expired. If not, the processor returns to step 210. If the time has expired, the processor increases the motor and belt speed at step 218 to rapidly present the passbook to the printer. This speed change may be operative to free a stuck passbook or to overcome resistance to entry into the nip rolls.

If the printer rejects the passbook at step 210, the processor changes the direction of travel of the belts at step 220 until sensor 130 unblocks at step 222. The belts are then stopped at step 224. The processor then checks to see how many times it has previously attempted entry of this passbook to the printer and compares it against a preset number at step 226. If the number of unsuccessful prior trials equals the preset maximum, the transport shuts off and a fault condition is indicated at step 228.

If the number of trials is less than the set maximum, the processor starts the passbook moving toward the printer again at step 230. A timing routine similar to routine 194 is started at step 232. The number of previous unsuccessful trials is incremented at step 234 and the program returns to step 196. The steps are repeated until the printer either accepts the passbook or until a fault condition occurs.

Figure 20:
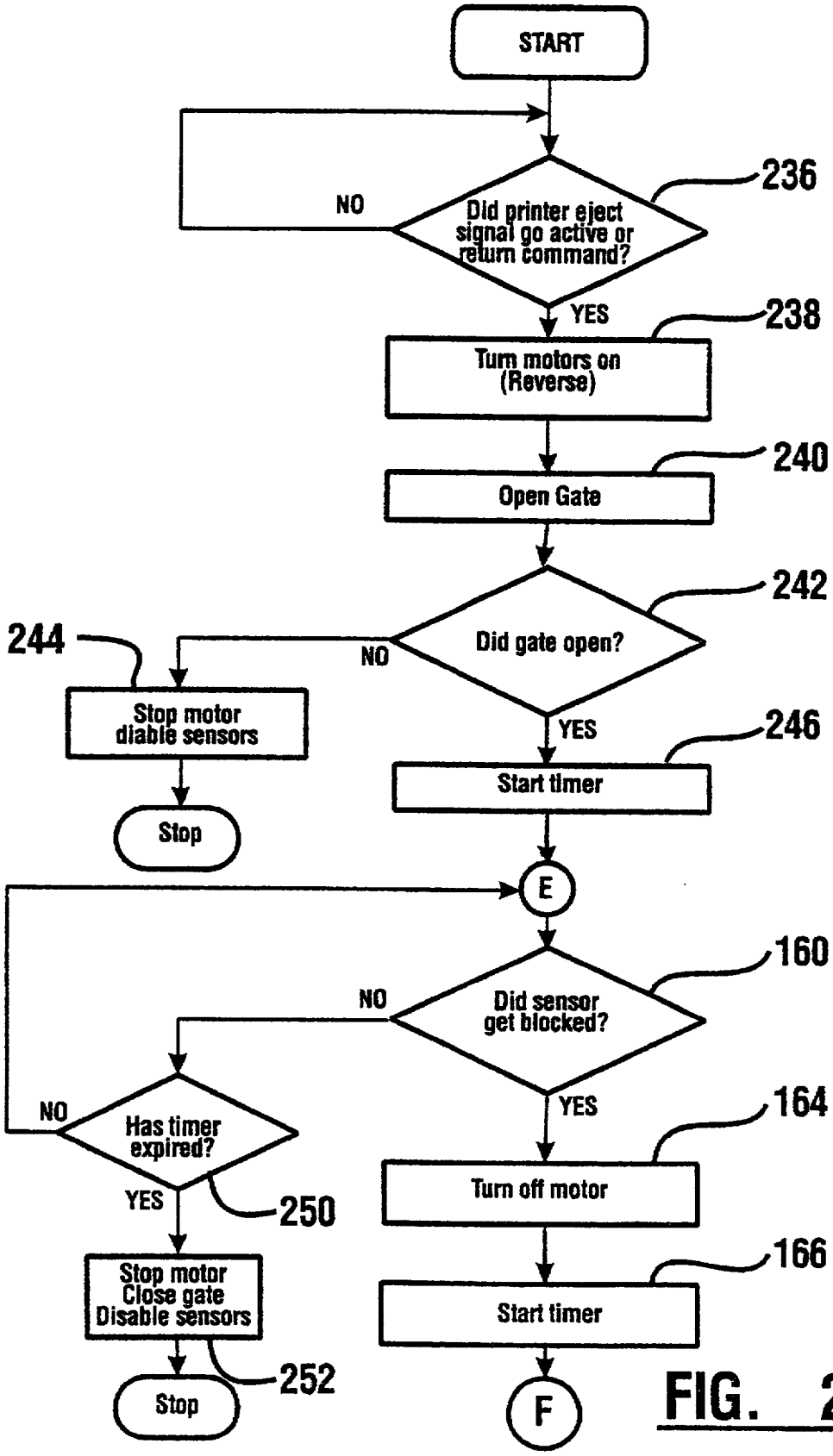
Figure 21:
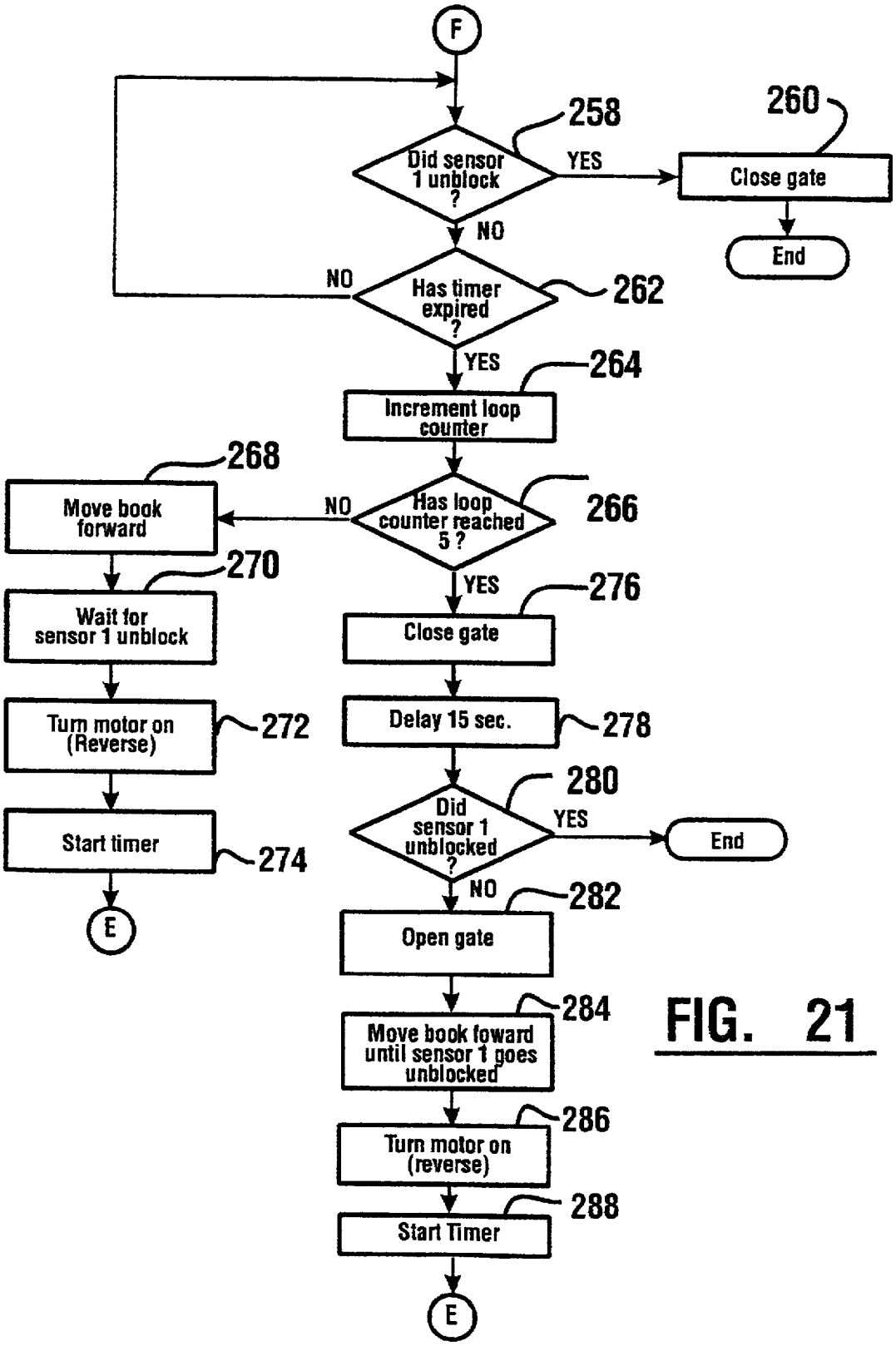

The portion of the computer program for returning the passbook from the printer to the customer is shown in FIGS. 20 and 21. The processor waits for a signal from the printer indicating the return of the passbook to the end of the transport path at step 236. In response to the signal the processor turns on the motor to run the belts in a reverse direction at step 238. The belts are run in the reverse direction somewhat faster than the linear speed of the nip rolls. The processor opens the gate member at step 240. Opening of the gate member is checked at step 242. If the gate fails to open the transport is shut off and a fault indicated at step 244.

Although in the program shown the belts are run in the reverse direction at a constant speed, in other embodiments the belts are run at a first speed until the passbook disengages the printer as sensed by the printer or by sensor 130. Thereafter the belts are run at a higher speed until the passbook reaches sensor 110.

The opening of the gate member causes initiation of a timing routine 246. The processor then looks to see if sensor 110 senses the passbook adjacent the entry slot at step 248. A check is made at step 250 to see if timing routine 246 has timed out before sensor 110 is blocked. If so there is a problem and the transport shuts down and indicates a fault at step 252.

Alternately, if time 246 has timed out before sensor 110 is blocked by the passbook, the processor increases the motor speed. This speed change often frees a passbook that has become stuck in the transport.

If the passbook reaches sensor 110 before timing routine 246 times out, the processor shuts off the motor at step 254 after a brief time delay, and starts another timing routine 256. The time delay before motor shut off insures that the passbook extends sufficiently from the transport so it can be taken by the customer. The processor then waits for sensor 110 to become unblocked, indicating the customer has taken the passbook at step 258. If the passbook is removed before the timing routine 256 times out, the gate is closed at step 260.

At step 262 the processor checks to see if the routine 256 has timed out. If the timing routine has timed out a counter is incremented at step 264. A check is made to see if the number stored in the counter has reached a preset number (which in the preferred embodiment is 5) at step 266. If not, the processor moves the belts to pull the passbook back into the transport at step 268. If sensor 110 becomes unblocked at step 270 the processor begins moving the belts and the passbook back towards the customer at step 272. A timing routine similar to routine 246 is initiated at step 274 and the program returns to step 248.

After the preset number of unsuccessful attempts to deliver the passbook to the customer at step 266, the processor closes the gate member at step 276. The program delays 15 seconds at step 278. At step 280 the processor again checks to see if sensor 110 is unblocked. If not the gate is again opened at step 282 and the processor starts moving the passbook into the transport until sensor 110 becomes unblocked at step 284. The transport is then started again to move the passbook back to the customer at step 286. A timing routine similar to routine 246 is initiated at step 288 and the program returns to step 248.

The passbook transport thus continues to try to deliver the passbook back to the customer until the passbook is taken. The repeated movement of the passbook in and out of the entry slot operates to get the customer's attention and helps assure that they will take their passbook.

A fundamental advantage of the present invention is its ability to transport a passbook or other article comprised of a single sheet or multiple sheets in a precisely aligned manner while providing limited slippage so as to prevent damage thereto when the passbook is delivered to the printer which moves at a different speed. The transport of the preferred embodiment is well suited to transporting passbooks which have covers, which gives each surface a different coefficient of friction and which have variable thickness in the open condition.

A further advantage of the present invention is that the transport may be readily modified to accept passbooks of different widths. This is accomplished by changing the position of the second edge guide 46 which may be moved by changing the position of angle bracket 50 in the slots 52 of the base plate 14. In addition, the positions of the second, third and fourth sensors may be readily modified to accommodate the length and width of any passbook with which the transport is desired to be used. Such modification may be readily accomplished and enables the passbook transport of the present invention to be used with a variety of passbooks.

A further advantage of the invention is that unlike other transports, there is no compression of the belts while idle, which can cause undesirable rubber compression, flat spots and belt creep. Scuffing of belts caused by speed differentials is also avoided. Such problems are common in transports which use abutting belts.

The "waffle" effect on items moved in the transport of the present invention causes stiffening when thin, flexible items are transported. This makes it easier to move the transported item through joints or gaps which may extend between the transport and other devices.

Another fundamental advantage of the invention is that skewing of passbooks is avoided. In prior transports which have opposed rollers or belts, items that have non-uniform thickness in a direction perpendicular to travel will tend to skew. This is because the greater thickness results in a pinching action and more drive force applied in the thicker area. Because the transport of the present invention is not so affected by articles with varying thickness, transport in an aligned direction is accomplished without skewing.

Although the preferred embodiment of the invention is used as a passbook transport, other types of materials or objects may be transported using embodiments of the invention. This may particularly include stacked articles such as sheets.

Thus, the passbook transport and handling apparatus for a banking machine of the present invention achieves the above-stated objectives, eliminates difficulties encountered in the use of prior devices and systems, solves problems and attains the desirable results described herein.

In the foregoing description, certain terms have been used for brevity, clarity and understanding. However, no unnecessary limitations are to be implied therefrom because such terms are for descriptive purposes and are intended to be broadly construed. Moreover, the descriptions and illustrations given are by way of examples and the invention is not limited to the exact details shown and described.

Having described the features, discoveries and principles of the invention, the manner in which it is constructed and operated and the advantages and useful results attained; the new and useful structures, devices, elements, arrangements, parts, combinations, systems, equipment, operations and relationships are set forth in the appended claims.

We claim:

1. A passbook transport apparatus for moving a passbook in an open condition along a path without skewing, said passbook comprising a plurality of attached sheets, said passbook being transportable in said apparatus when open to any one of said sheets, said open passbook having a maximum thickness when open to at least one of said sheets, said passbook having a first side spanning said open sheets, and a second side opposed of said first side, said apparatus comprising:

a plurality of first belt flights extending in a longitudinal direction along said path, said first belt flights being generally co-planar and transversely disposed from one another, wherein each first belt flight is in supporting connection with at least one first belt supporting member along said path, and wherein each of said first flights includes a first engaging face engageable with said first side of said passbook and a first opposed face opposed of said first engaging face, said first opposed face in supporting connection with the first belt supporting member, and wherein a first open area extends adjacent to each said first belt flight longitudinally along said entire path, said first to open area extending in a first clearance direction normal of said first engaging face;

at least one second belt flight extending in said longitudinal direction along said path, said second belt flight generally co-planar with said first belt flights and transversely disposed between an adjacent pair of said first belt flights, wherein said second belt flight is in supporting connection with at least one second belt supporting member along said path, and wherein said second belt flight includes a second engaging face engageable with said second side of said passbook and a second opposed face opposed of said second engaging face, said second opposed face in supporting connection with the second belt supporting member, and wherein a second open area extends adjacent said second belt flight along said entire path, and wherein said second open area extends in an opposed clearance direction from said second engaging face, wherein said second open area extends beyond said first opposed faces along said entire path, and wherein said first open area extends in the first clearance direction from said first engaging face beyond the second opposed face along said entire path; and a drive moving said first and second belt flights in the longitudinal direction, whereby said passbook is enabled to be carried on said belt flights in said open condition without skewing.

2. A passbook transport apparatus for moving a passbook in an open condition along a transport path without skewing, said passbook comprising a plurality of attached sheets, said passbook being transportable in said apparatus when open to any one of said sheets, said open passbook having a maximum thickness when open to at least one of said sheets, said passbook having a first side spanning said open sheets and a second side opposed of said first side, and apparatus comprising:

a plurality of first belt flights extending in a longitudinal direction along said path, said first belt flights being generally co-planar and transversely disposed from one another, wherein each first belt flight is in supporting connection with at least one belt supporting member along said path, and wherein each of said first belt flights includes a first engaging face engageable with said first side of said passbook and a first opposed face opposed of said first engaging face, wherein said first opposed face is in supporting connection with the first belt supporting member;

at least one second belt flight, said second belt flight extending in the longitudinal direction along said path and being generally co-planar with said first belt flights, wherein said second belt flight is transversely disposed intermediate of said first belt flights, and wherein said second belt flight is in supporting connection with at least one second belt supporting member along said path, and wherein said second belt flight includes a second engaging face engageable with said second side of said passbook and a second opposed face opposed of said second engaging face, wherein said second opposed face is in supporting connection with the second belt supporting member;

a first open area extending adjacent each of said first belt flights, each said first open area extending along said entire path, and wherein each first open area extends from said first engaging face in a first clearance direction, said first clearance direction extending from said first engaging face normal to both said longitudinal and transverse directions, and wherein said first open area extends in said first clearance direction beyond said second opposed face along said entire path;

a second open area extending adjacent said second belt flight, said second open area extending along said entire path, and wherein said second open area extends in an opposed clearance direction from said second engaging face beyond said first opposed faces along said entire path; and a drive moving said first and second belt flights in the longitudinal direction.

3. A passbook transport apparatus for moving a passbook in an open condition along a path without skewing, said passbook comprising a plurality of attached sheets, said passbook being transportable in said apparatus when open to any one of said sheets, said passbook having a maximum thickness when opened to at least one of said sheets, said passbook having a first side spanning said open sheets and a second side opposed of said first side, said apparatus comprising:

a plurality of first belt flights extending in a longitudinal direction along said path, said first belt flights transversely disposed from one another, wherein each said first belt flight is in supporting connection with at least one first belt supporting member along said path, and wherein each said first belt flight includes a first engaging face and a first opposed face opposed of said first engaging face, said first opposed face in supporting connection with said first belt supporting member;

at least one second belt flight extending in the longitudinal direction along said path, wherein said second belt flight is in supporting connection with at least one second belt supporting member along said path, said second belt flight including a second engaging face and a second opposed face opposed of said second engaging face, said second opposed face in supporting connection with the second belt supporting member, and wherein said second belt flight is transversely disposed intermediate of an adjacent pair of said first belt flights, and wherein said passbook is transportable along said path in the open condition in an engaged intermediate relation with said first and second belt flights;

a first open area extending adjacent each said first belt flight, each said first open area extending longitudinally the entire length of said path and extending from each first engaging face in a clearance direction normal of said first engaging face, said first open area extending beyond said second opposed face along said entire path;

a second open area extending adjacent said second belt flight, said second open area extending longitudinally the entire length of said path and extending from said second engaging face in a direction opposed of said clearance direction, said second open area extending beyond said first opposed faces along said entire path; and a drive moving said first and second belt flights in the longitudinal direction.

4. A passbook transport apparatus for transporting a passbook having a plurality of attached sheets in an open condition, said apparatus transporting said passbook in a longitudinal direction along a path without skewing, said passbook having a maximum thickness when open to at least one of said sheets, said apparatus comprising:

a plurality of first belt flights, said first belt flights extending in the longitudinal direction along said path, each said first belt flight having a first passbook engaging face and a first opposed face, each first opposed face in supporting connection with at least one first belt supporting member along said path;

at least one second belt flight, said second belt flight extending in the longitudinal direction along said path and transversely disposed intermediate of an adjacent pair of said first belt flights, the second belt flight having a second passbook engaging face and a second opposed face, the second opposed face supporting connection with at least one second belt supporting member along said path, and wherein said second engaging face faces in a first direction and said first engaging face faces in an opposed direction;

an open area, said open area adjacent said second belt flight, said open area bounded by said second belt flight and bounded transversely by said pair of first belt flights, and wherein said open area extends in said first direction beyond said first opposed faces along said entire path; and wherein upon movement of said first and second belt flights in the longitudinal direction said passbook is engageable in supported intermediate relation between said first and second belt flights.

5. The apparatus according to claim 4 and further comprising:

a pair of second belt flights, wherein one first belt flight extends transversely between said pair of second belt flights; and a further clearance area adjacent said one first belt flight and extending along said entire path in the longitudinal direction, said further clearance area bounded transversely by said pair of second belt flights, and wherein said further clearance area extends in said opposed direction beyond said second opposed face along said entire path.

6. A passbook transport apparatus for transporting a passbook in an open condition in a longitudinal direction, wherein said passbook comprises a plurality of attached sheets, and wherein said passbook has a first side spanning said open sheets and a second side opposed of said first side, and wherein said passbook is generally rigid but deformable in a direction transverse to said longitudinal direction, and wherein said passbook has a maximum thickness when open to at least one of said sheets comprising:

a plurality of said first and second belt flights, said first and second belt flights generally co-planar and extending in the longitudinal direction along the transport path, wherein said first belt flights include a first engaging face engageable with said first side of said passbook and a first opposed face, and wherein said second belt flights include a second engaging face engageable with said second side of said passbook and a second opposed face, wherein each first opposed face is in supporting connection with at least one first belt supporting member along said transport path and each second opposed face is in supporting connection with at least one second belt supporting member along said transport path, and wherein when said first engaging faces of said first belt flights are engaged with said first side of said passbook said second engaging faces of said second belt flights are engaged with the second side of said passbook, and wherein said second belt flights are transversely disposed from said first belt flights a distance sufficient to enable deformation of said passbook due to engagement with said belt flights without significant resistance, and wherein each said first belt flight has an associated first open area, and wherein each first open area extends along said entire transport path and is bounded by each transversely adjacent second belt flight, and wherein each first open area extends from said first engaging face in a first direction normal of said first engaging face and extends beyond said second opposed face along said entire path, and wherein each second belt flight has an associated second open area, and wherein each second open area extends along said entire transport path and is bounded by each transversely adjacent first belt flight, and wherein each second open area extends from said second engaging face in a direction opposed of said first direction and extends beyond said first opposed faces along said entire path, and further comprising a drive moving said belt flights in the longitudinal direction.

7. A method for transporting a passbook in an open condition without skewing along a path, wherein said passbook comprises a plurality of attached sheets and wherein said passbook has a first side spanning said open sheets and a second side opposed of said first side, and wherein the passbook has the maximum thickness when open to at least one sheet, comprising the steps of:

inserting said passbook in an open condition between a plurality of first and second belt flights, wherein said first belt flights extend in a longitudinal direction along said path, and wherein each first belt flight has a first engaging face engageable with the passbook, and a first opposed face, wherein the first opposed face is in supporting connection with at least one first belt supporting member along said path, and wherein at least one second belt flight extends in the longitudinal direction along said path and is transversely disposed of each of said first belt flights, and wherein said second belt flight has a second engaging face engageable with the passbook, and a second opposed face, wherein the second opposed face is in supporting connection with at least one second belt supporting member along said path, and wherein each of said first belt flights has a first open area adjacent thereto, wherein each said first open area extends in the longitudinal direction along said entire path and wherein each said first open area extends in a direction generally normal of said first engaging face toward said passbook and extends beyond said second opposed face along said entire path, and wherein said second belt flight has a second open area adjacent thereto, wherein said second open area extends along said entire path, and wherein said second open area extends in an opposed direction generally normal of said second engaging face toward said passbook and extends beyond said first opposed faces along said entire path;

moving said first and second belt flights in the longitudinal direction with a drive;

engaging said passbook with said first engaging face of said first belt flights and said second engaging face of said second belt flight, wherein said first side engages said first belt flights and said second side engages said second belt flights; and transporting said passbook along said path through said first and second open areas in engaged relation with said belt flights.

8. The method according to claim 7 wherein said second side of said passbook comprises a passbook cover having a different coefficient of friction from said first side, and wherein said engaging step comprises engaging said cover with said second belt flights.

9. The method according to claim 7 wherein said engaging step comprises deforming said passbook to extend in said open areas.

10. The method according to claim 7 wherein said moving step comprises moving each said belt flight on a pulley, wherein each pulley supports only said associated belt flights, and wherein said open areas extend transversely between said pulleys.

11. A transport apparatus for moving a stack comprising a plurality of abutting sheets along a path, said stack having a first side spanning a first sheet bounding the first side of the stack, and a second side spanning a second sheet bounding the second side of the stack opposed of said first side, said apparatus comprising:

a plurality of first belt flights extending in a longitudinal direction along said path, said first belt flights being generally co-planar and transversely disposed from one another, wherein each first belt flight is in supporting connection with at least one first belt supporting member along said path, and wherein each of said first flights includes a first engaging face engageable with said first side of said stack and a first opposed face opposed of said first engaging face, said first opposed face in supporting connection with the first belt supporting member, and wherein a first open area extends adjacent to each said first belt flight longitudinally along said entire path, said first open area extending in a first clearance direction normal of said first engaging face;

at least one second belt flight extending in said longitudinal direction along said path, said second belt flight generally co-planar with said first belt flights and transversely disposed between an adjacent pair of said first belt flights, wherein said second belt flight is in supporting connection with at least one second belt supporting member along said path, and wherein said second belt flight includes a second engaging face engageable with said second side of said stack and a second opposed face opposed of said second engaging face, said second opposed face in supporting connection with the second belt supporting member, and wherein a second open area extends adjacent said second belt flight along said entire path, and wherein said second open area extends in an opposed clearance direction from said second engaging face, wherein said second open area extends beyond said first opposed faces along said entire path, and wherein said first open area extends in the first clearance direction from said first engaging face beyond the second opposed face along said entire path; and a drive moving said first and second belt flights in the longitudinal direction.

12. A transport apparatus for moving a stack comprising a plurality of abutting sheets along a path, said stack having a first side spanning a first sheet bounding the first side of the stack, and a second side spanning a second sheet bounding the second side of the stack opposed of said first side, said apparatus comprising:

a plurality of first belt flights extending in a longitudinal direction along said path, said first belt flights being generally co-planar and transversely disposed from one another, wherein each first belt flight is in supporting connection with at least one belt supporting member along said path and wherein each of said first belt flights includes a first engaging face engageable with said first side of said stack and a first opposed face opposed of said first engaging face, wherein said first opposed face is in supporting connection with the first belt supporting member;

at least one second belt flight, said second belt flight extending in the longitudinal direction along said path and being generally co-planar with said first belt flights, wherein said second belt flight is transversely disposed intermediate of said first belt flights, and wherein said second belt flight is in supporting connection with at least one second belt supporting member along said path, and wherein said second belt flight includes a second engaging face engageable with said second side of said stack and a second opposed face opposed of said second engaging face, wherein said second opposed face is in supporting connection with the second belt supporting member;

a first open area extending adjacent each of said first belt flights, each said first open area extending along said entire path, and wherein each first open area extends from said first engaging face in a first clearance direction, said first clearance direction extending from said first engaging face normal to both said longitudinal and transverse directions, and wherein said first open area extends in said first clearance direction beyond said second opposed face along said entire path;

a second open area extending adjacent said second belt flight, said second open area extending along said entire path, and wherein said second open area extends in an opposed clearance direction from said second engaging face beyond said first opposed faces along said entire path; and a drive moving said first and second belt flights in the longitudinal direction.

13. A transport apparatus for moving a stack comprising a plurality of abutting sheets along a path, said stack having a first side spanning a first sheet bounding the first side of the stack, and a second side spanning a second sheet bounding the second side of the stack opposed of said first side, said apparatus comprising;

a plurality of first belt flights extending in a longitudinal direction along said path, said first belt flights transversely disposed from one another, wherein each said first belt flight is in supporting connection with at least one first belt supporting member along said path, and wherein each said first belt flight includes a first engaging face and a first opposed face opposed of said first engaging face, said first opposed face in supporting connection with said first belt supporting member;

at least one second belt flight extending in a longitudinal direction along said path, wherein said second belt flight is in supporting connection with at least one second belt supporting member along said path, said second belt flight including a second engaging face and a second opposed face opposed of said second engaging face, said second opposed face in supporting connection with the second belt supporting member, and wherein said second belt flight is transversely disposed intermediate of an adjacent pair of said first belt flights, and wherein said stack is transportable along said path in an engaged intermediate relation with said first and second belt flights;

a first open area extending adjacent each said first belt flight, each said first open area extending longitudinally the entire length of said path and extending from each first engaging face in a clearance direction normal of said first engaging face, said first open area extending beyond said second opposed face along said entire path;

a second open area extending adjacent said second belt flight, said second open area extending longitudinally the entire length of said path and extending from said second engaging face in a direction opposed of said clearance direction, said second open area extending beyond said first opposed faces along said entire path; and a drive moving said first and second belt flights in the longitudinal direction.

14. A transport apparatus for transporting a stack comprising a plurality of abutting sheets in a longitudinal direction along a path, said apparatus comprising:

a plurality of first belt flights, said first belt flights extending in the longitudinal direction along said path, each said first belt flight having a first stack engaging face and a first opposed face, each first opposed face in supporting connection with at least one first belt supporting member along said path;

at least one second belt flight, said second belt flight extending in the longitudinal direction along said path and transversely disposed intermediate of an adjacent pair of said first belt flights, the second belt flight having a second stack engaging face and a second opposed face, the second opposed face in supporting connection with at least one second belt supporting member along said path, and wherein said second engaging face faces in a first direction and said first engaging face faces in an opposed direction;

an open area, said open area adjacent said second belt flight, said open area bounded by said second belt flight and bounded transversely by said pair of first belt flights, and wherein said open area extends in said first direction beyond said first opposed faces along said entire path; and wherein upon movement of said first and second belt flights in the longitudinal direction said stack is engageable in supported intermediate relation between said first and second belt flights.

15. The apparatus according to claim 14 and further comprising:

a pair of second belt flights, wherein one first belt flight extends transversely between said pair of second belt flights; and a further clearance area adjacent said one first belt flight and extending along said entire path in the longitudinal direction, said further clearance area bounded transversely by said pair of second belt flights, and wherein said further clearance area extends in said opposed direction beyond said second opposed face along said entire path.

16. A transport apparatus for transporting a stack comprising a plurality of abutting sheets in a longitudinal direction, and wherein said stack has a first side spanning a first sheet bounding the first side of the stack and a second side spanning a second sheet bounding the second side of the stack opposed of said first side, and wherein said stack is generally rigid but deformable in a direction transverse to the longitudinal direction, comprising:

a plurality of said first and second belt flights, said first and second belt flights generally co-planar and extending in the longitudinal direction along the transport path, wherein said first belt flights include a first engaging face engageable with said first side of said stack and a first opposed face, and wherein said second belt flights include a second engaging face engageable with said second side of said stack and a second opposed face, wherein each first opposed face is in supporting connection with at least one first belt supporting member along said transport path and each second opposed face is in supporting connection with at least one second belt supporting member along said transport path, and wherein when said first engaging faces of said first belt flights are engaged with said first side of said stack said second engaging faces of said second belt flights are engaged with the second side of said stack, and wherein said second belt flights are transversely disposed from said first belt flights a distance sufficient to enable deformation of said stack due to engagement with said belt flights without significant resistance, and wherein each said first belt flight has an associated first open area, and wherein each first open area extends along said entire transport path and is bounded by each transversely adjacent second belt flight, and wherein each first open area extends from said first engaging face in a first direction normal of said first engaging face and extends beyond said second opposed face along said entire path, and wherein each second belt flight has an associated second open area, and wherein each second open area extends along said entire transport path and is bounded by each transversely adjacent first belt flight, and wherein each second open area extends from said second engaging face in a direction opposed of said first direction and extends beyond said first opposed faces along said entire path, and further comprising a drive moving said belt flights in the longitudinal direction.

17. A method for transporting a stack comprising a plurality of abutting sheets along a path, wherein said stack has a first side spanning a first sheet bounding the first side of the stack, and a second side spanning a second sheet bounding the second side of the stack opposed of said first side, comprising the steps of:

inserting said stack between a plurality of first and second belt flights, wherein said first belt flights extend in a longitudinal direction along said path, and wherein each first belt flight has a first engaging face engageable with the stack, and a first opposed face, wherein the first opposed face is in supporting connection with at least one first belt supporting member along said path, and wherein at least one second belt flight extends in the longitudinal direction along said path and is transversely disposed of each of said first belt flights, and wherein said second belt flight has a second engaging face engageable with the stack, and a second opposed face, wherein the second opposed face is in supporting connection with at least one second belt supporting member along said path, and wherein each of said first belt flights has a first open area adjacent thereto, wherein each said first open area extends in the longitudinal direction along said entire path and wherein each said first open area extends in a direction generally normal of said first engaging face toward said stack and extends beyond said second opposed face along said entire path, and wherein said second belt flight has a second open area adjacent thereto, wherein said second open area extends in an opposed direction generally normal of said second engaging face toward said stack and extends beyond said first opposed faces along said entire path;

moving said first and second belt flights in the longitudinal direction with a drive;

engaging said stack with said first engaging face of said first belt flights and said second engaging face of said second belt flight, wherein said first side engages said first belt flights and said second side engages said second belt flights; and transporting said stack along said path through said first and second open areas in engaged relation with said belt flights.

* * * * *